US010564579B2

(12) United States Patent
Ogawa et al.

(10) Patent No.: US 10,564,579 B2
(45) Date of Patent: Feb. 18, 2020

(54) FIXING APPARATUS

(71) Applicant: CANON KABUSHIKI KAISHA, Tokyo (JP)

(72) Inventors: Kenichi Ogawa, Kawasaki (JP); Takashi Narahara, Mishima (JP); Toru Imaizumi, Kawasaki (JP); Yasuhito Minamishima, Odawara (JP); Tsuguhiro Yoshida, Yokohama (JP); Masashi Tanaka, Kawasaki (JP); Kensuke Umeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/122,502

(22) Filed: Sep. 5, 2018

(65) Prior Publication Data

US 2019/0004460 A1 Jan. 3, 2019

Related U.S. Application Data

(63) Continuation of application No. 15/295,868, filed on Oct. 17, 2016, now Pat. No. 10,095,165, which is a continuation of application No. 14/869,622, filed on Sep. 29, 2015, now Pat. No. 9,501,012.

(30) Foreign Application Priority Data

Oct. 1, 2014 (JP) ..... 2014-203020
Nov. 14, 2014 (JP) ..... 2014-232199

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
USPC ..... 399/329
See application file for complete search history.

(56) References Cited

U.S. PATENT DOCUMENTS

2016/0139551 A1* 5/2016 Narahara ..... G03G 15/55 399/33
2016/0246229 A1* 8/2016 Taguchi ..... G03G 15/2053

* cited by examiner

*Primary Examiner* — Quana Grainger
(74) *Attorney, Agent, or Firm* — Canon U.S.A., Inc. IP Division

(57) ABSTRACT

A fixing apparatus for fixing a toner image to a recording material includes a cylindrical film, a heater configured to make contact with the film, the heater including a substrate and a heat generation resistor formed on the substrate, and a heat conduction member configured to make contact with a surface of the heater opposite to a surface thereof being in contact with the film, the heat conduction member having a higher thermal conductivity than that of the substrate, and being divided into parts in a generatrix direction of the film. The toner image formed on the recording material is fixed on the recording material by using heat of the film, and one of the parts of the heat conduction member is configured to make contact with the heater continuously from a center to an end of a heat generation region of the heater in the generatrix direction.

10 Claims, 21 Drawing Sheets

FRONT SIDE

BACK SIDE

BACK SIDE

FRONT SIDE

FIXING APPARATUS

CROSS REFERENCE TO RELATED APPLICATIONS

This application is a Continuation of U.S. patent Ser. No. 15/295,868 filed Oct. 17, 2016, which is a Continuation of U.S. patent application Ser. No. 14/869,622 filed Sep. 29, 2015, now U.S. Pat. No. 9,501,012 issue date Jul. 20, 2016, which claims the benefit of Japanese Patent Application Nos. 2014-203020, filed Oct. 1, 2014 and 2014-232199, filed Nov. 14, 2014, all of which are hereby incorporated by reference herein in their entireties.

BACKGROUND OF THE INVENTION

Field of the Invention

The present invention relates to a fixing apparatus used in an image forming apparatus that employs an electrophotographic or electrostatic recording image forming process, such as a copying machine, a laser beam printer, and a light-emitting diode (LED) printer.

Description of the Related Art

A fixing apparatus using a film is known as a fixing apparatus included in an electrophotographic or electrostatic recording image forming apparatus. The fixing apparatus includes a cylindrical film and a heater which makes contact with an inner surface of the film. The fixing apparatus fixes a toner image formed on a recording material to the recording material by using heat of the film.

Since the film has a small heat capacity, the fixing apparatus has an advantage of short warm-up time. However, when performing continuous fixing processing on small-sized recording materials, the fixing apparatus is more likely to cause a temperature rise of a non-sheet passing portion. The temperature rise of a non-sheet passing portion refers to a phenomenon where the temperature of the non-sheet passing portion, which is a region where no recording materials pass, rises excessively. Japanese Patent Application Laid-Open No. 11-260533 discusses an apparatus in which a long narrow aluminum plate is longitudinally put in contact with a heater so that the movement of heat of a non-sheet passing portion is promoted to suppress the temperature rise of the non-sheet passing portion.

However, the metal plate discussed in Japanese Patent Application Laid-Open No. 11-260533 is formed in a long narrow shape (an aluminum plate with a length of 230 mm, a width of 10 mm, and a thickness of 1.0 mm) according to the size of the heater. The metal plate is thus prone to warping, which can affect the adhesion of the metal plate to the heater. To suppress the warpage of the metal plate, the metal plate may be configured to be longitudinally divided in a plurality of parts. However, there is a problem that the movement of heat by the metal plate between a central portion and ends can be hindered depending on how the metal plate is divided.

SUMMARY OF THE INVENTION

According to an aspect of the present invention, a fixing apparatus for fixing a toner image to a recording material includes a cylindrical film, a heater configured to make contact with the film, the heater including a substrate and a heat generation resistor formed on the substrate, and a heat conduction member configured to make contact with a surface of the heater opposite to a surface thereof being in contact with the film, the heat conduction member having a higher thermal conductivity than that of the substrate, and being divided into a plurality of parts in a generatrix direction of the film. The toner image formed on the recording material is fixed on the recording material by using heat of the film, and one of the parts obtained by dividing the heat conduction member is configured to make contact with the heater continuously from a center to an end of a heat generation region of the heater in the generatrix direction.

Further features of the present invention will become apparent from the following description of exemplary embodiments with reference to the attached drawings.

DESCRIPTION OF THE EMBODIMENTS

A first exemplary embodiment of the present invention will be described with reference to FIGS. 1 to 7.

(Image Forming Apparatus)

Figure 1:
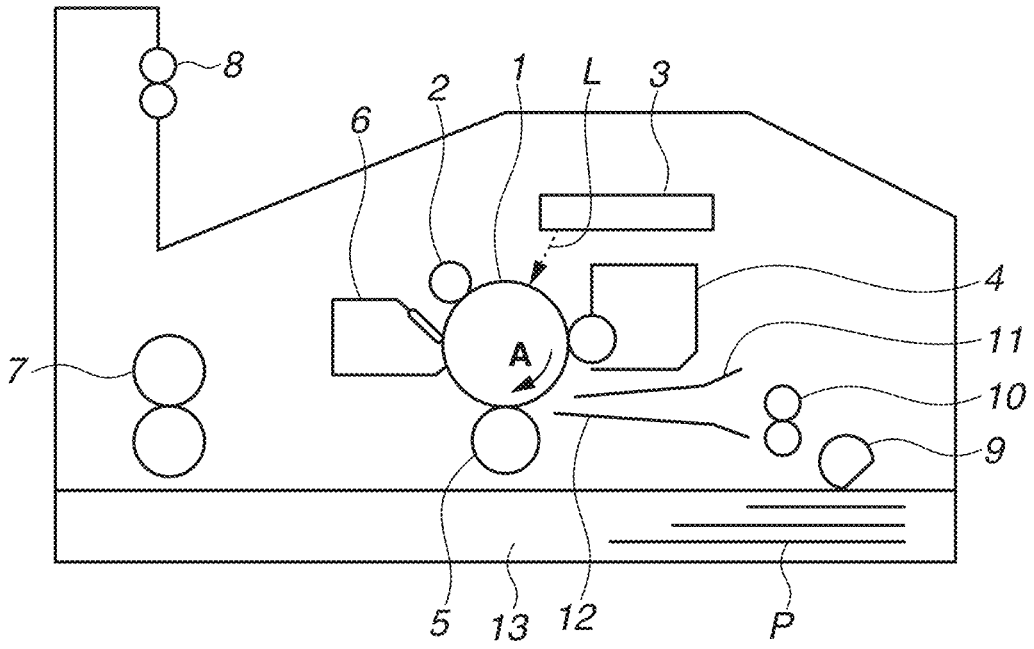
FIG. 1 is a schematic sectional view of an image forming apparatus according to a first exemplary embodiment.

FIG. 1 illustrates a schematic sectional view of a laser beam printer, which is an image forming apparatus according to a first exemplary embodiment of the present invention.

The laser beam printer includes a process cartridge which holds a drum-shaped electrophotographic photosensitive member (hereinafter referred to as a "photosensitive member") 1 serving as an image bearing member, a charging unit 2, and a developing unit 4. The laser beam printer further includes a laser scanner unit 3 which forms, through an exposure processing process according to input image information, an electrostatic latent image on an outer peripheral surface of the photosensitive member 1 according to the image information. The laser beam printer further includes a transfer unit 5 which transfer an image onto a recording material P, and a fixing unit (fixing apparatus) 7 which performs fixing processing on the recording material P with the image transferred thereto by application of heat and pressure.

In response to receiving a print signal, the laser beam printer starts driving the photosensitive member 1 to rotate. The photosensitive member 1 is driven to rotate in the direction indicated by an arrow A illustrated in FIG. 1 at a predetermined circumferential speed. At this time, a power supply (not illustrated) applies a bias to the charging unit 2, and a surface of the photosensitive member 1 is charged to a predetermined surface potential.

Next, the laser scanner unit 3 performs scanning and exposure on the charged portion of the surface of the photosensitive member 1 according to image information, whereby an electrostatic latent image according to the image formation is formed on the surface of the photosensitive member 1. The formed electrostatic latent image is developed and visualized as a toner image by the developing unit 4.

Meanwhile, a feed roller 9 is driven to separate and feed the recording material P from recording materials stacked in a sheet feed cassette 13. The recording material P is conveyed to a transfer nip portion formed between the photosensitive member 1 and the transfer unit 5 by a registration roller pair 10 at predetermined timing. As the recording material P is conveyed through the transfer nip portion, the toner image formed on the photosensitive member 1 is transferred onto the recording material P. After the transfer processing, the recording material P is conveyed to the fixing unit 7, and discharged to the outside of the laser beam printer via a discharge unit 8.

The image forming process has been described up to this point.

(Fixing Apparatus)

Figure 2:
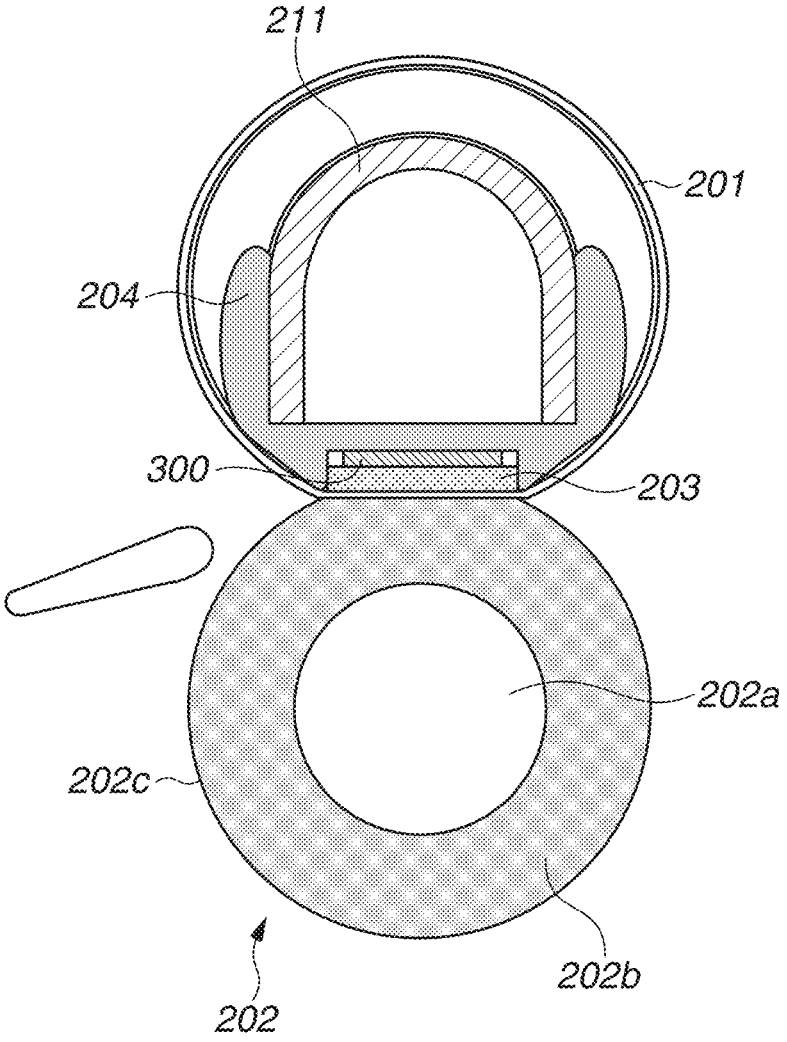
FIG. 2 is a schematic sectional view of a fixing apparatus according to the first exemplary embodiment.

Next, the fixing apparatus 7 will be described with reference to FIG. 2. In FIG. 2, the fixing apparatus 7 includes a cylindrical film 201 and a pressure roller 202 which serves as a backup member. A heater 203 makes contact with an inner surface of the film 201. A metal plate 300 serves as a heat conduction member in contact with the heater 203. A heater holder 204 serves as a support member for supporting the heater 203 via the metal plate 300. The metal plate 300 is sandwiched between the heater 203 and the heater holder 204. A stay 211 is intended to improve flexural rigidity of the support member (heater holder) 204. The heater 203 and the pressure roller 202 form a nip portion for conveying a recording material, with the film 201 therebetween. In the description of the fixing apparatus 7, a longitudinal direction refers to the same direction as a generatrix direction of the film 201.

The film 201 includes a base layer and a surface layer formed on the outside of the base layer. The base layer is made of resin such as polyimide (PI) and polyether ether ketone (PEEK), or metal such as stainless used steel (SUS) and nickel. The surface layer is made of a material having excellent releasability, such as fluorine resin.

Figure 6:
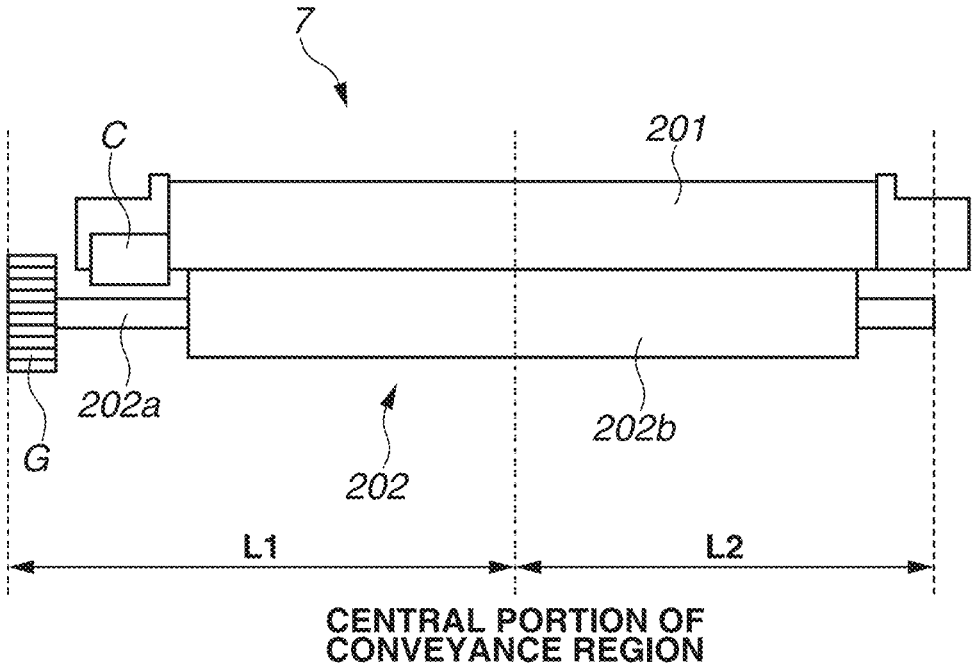
FIG. 6 is a view of the fixing apparatus according to the first exemplary embodiment as seen in a recording material conveyance direction.

As illustrated in FIG. 2, the pressure roller 202 includes a core 202*a*, a rubber layer 202*b* which is formed on the outside of the core 202*a*, and a release layer 202*c* which is formed on the outside of the rubber layer 202*b*. The core 202*a* is made of metal such as iron and aluminum. The rubber layer 202*b* is made of silicone rubber or silicone sponge. The release layer 202*c* is made of fluorine resin. FIG. 6 schematically illustrates the fixing apparatus 7. As illustrated in FIG. 6, a gear G for receiving a driving force from a not-illustrated driving source is provided on one end of the core 202*a* of the pressure roller 202. In view of the space for providing the gear G on the core 202*a*, the core 202*a* of the pressure roller 202 has the following length. The length (distance L1) of the core 202*a* from a central portion of a recording material conveyance region to an end (one end) of the core 202*a* on the side where the gear G is provided is longer than the length (distance L2) of the core 202*a* from the central portion to an end (the other end) of the core 202*a* on the side where the gear G is not provided. Hereinafter, the side where the gear G is provided on the core 202*a* of the pressure roller 202 will be referred to as a long shaft side. The side where the gear G is not provided will be referred to as a short shaft side. In the present exemplary embodiment, the central portion of the recording material conveyance region of the pressure roller 202 (nip portion) coincides with a central portion of a heat generation region of the heater 203.

The heater holder 204 illustrated in FIG. 2 is made of resin having high heat resistance, such as polyphenylene sulfide (PPS) and liquid crystal polymer (LCP). The heater holder 204 supports the heater 203, and also functions as a guide member for guiding the film 201 from the inner surface.

Figure 3A:
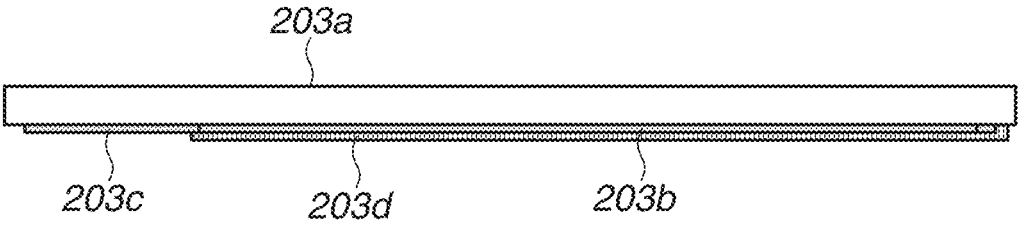
FIG. 3A is a side view of a heater according to the first exemplary embodiment.
Figure 3B:
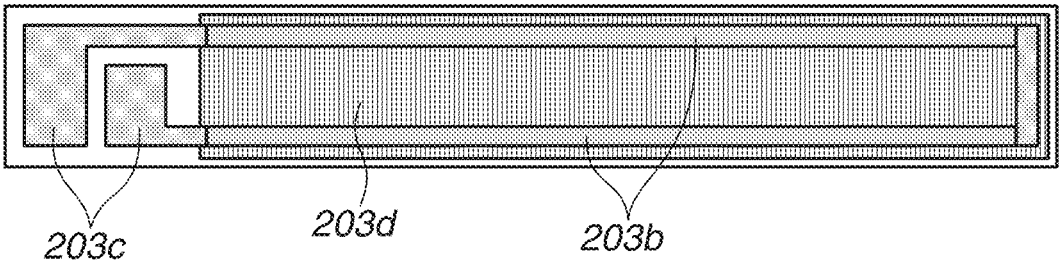
FIG. 3B is a front view of the heater according to the first exemplary embodiment.

A configuration of the heater 203 will be described with reference to FIGS. 3A and 3B. FIG. 3A is a side view of the heater 203. FIG. 3B is a front view of the front side of the heater 203. The heater 203 includes a substrate 203*a*, heat generation resistors 203*b* which are formed on the substrate 203*a*, a protection layer 203*d* which protects the heat generation resistors 203*b*, and electrode portions 203*c* which are electrically connected to the heat generation resistors 203*b*. The substrate 203*a* is made of ceramic such as alumina and aluminum nitride. The heat generation resistors 203*b* are formed on the substrate 203*a* by screen printing using a silver-palladium alloy. The electrode portions 203*c* are made of silver. The protection layer 203*d* is a glass coating. The protection layer 203*d* also contributes to the improvement of slidability over the film 201.

The heater 203 according to the present exemplary embodiment includes the substrate 203*a* made of 1-mmthick alumina, on which two traces of a silver palladium (Ag/Pd) paste are formed in a longitudinal direction as the heat generation resistors 203*b*. At the end of the substrate 203*a* on the short shaft side, the ends of the two heat generation resistors 203*b* are electrically connected to each other by an applied and sintered trace of silver. At the end of the substrate 203*a* on the long shaft side, the electrode portions 203*c* are formed by applied and sintered traces of silver. The two heat generation resistors 203*b* are connected in series, and adjusted to have a total resistance of 18Ω. A connector C illustrated in FIG. 6 is connected to the electrode portions 203*c*, whereby power is supplied to the electrode portions 203*c* from a power supply (not illustrated). The glass coating (protection layer) 203*d* is applied over the heat generation resistors 203*b* of the heater 203.

Figure 4:
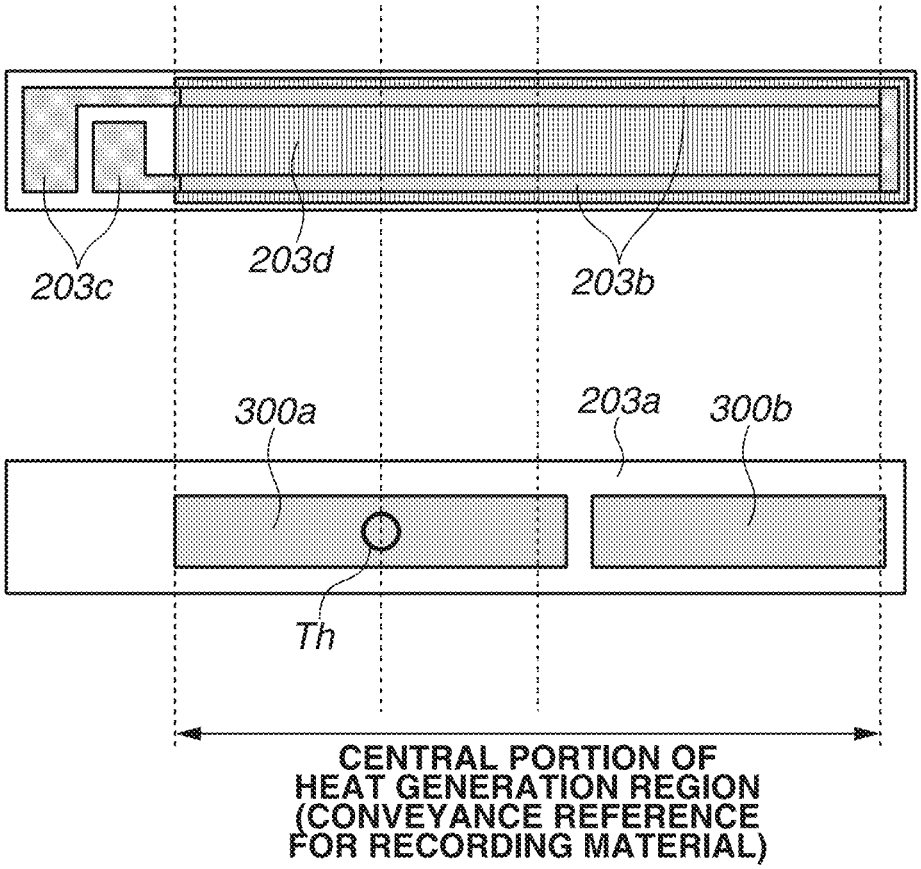
FIG. 4 illustrates positions of heat conduction members according to the first exemplary embodiment.
Figure 5:
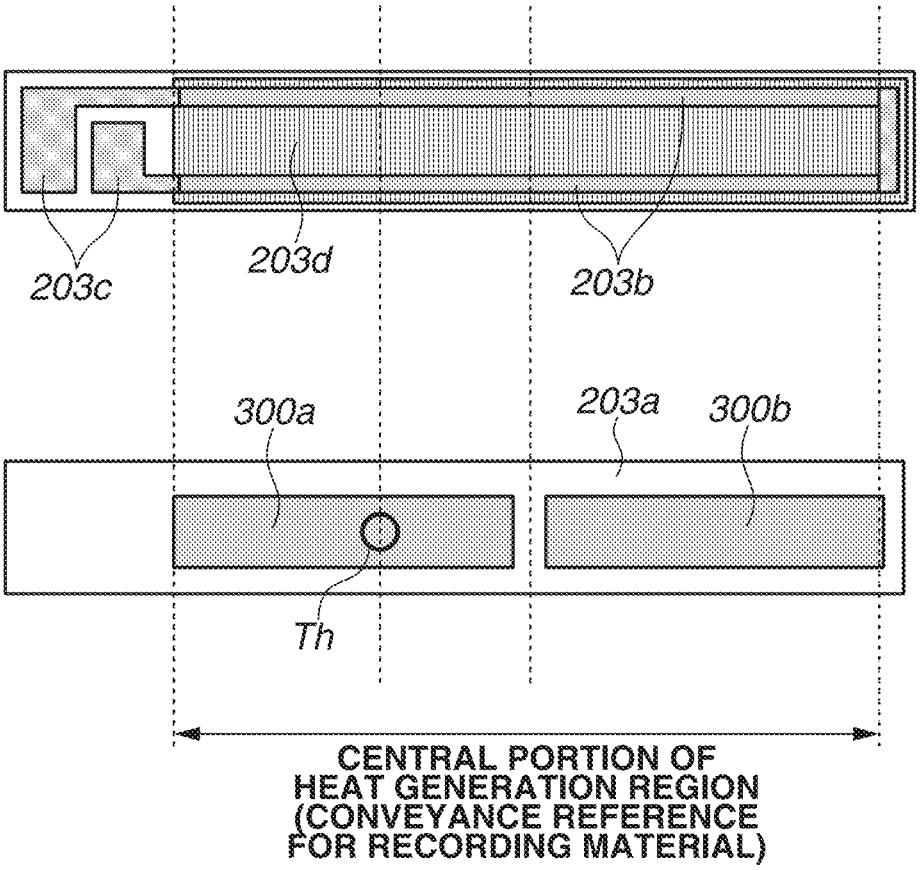
FIG. 5 illustrates positions of heat conduction members according to Comparative Example 2.

Next, a configuration of the metal plate 300 according to the present exemplary embodiment will be described with reference to FIG. 4. The upper half of FIG. 4 is the same as FIG. 3B. The lower half of FIG. 4 is a view of the heater 203 and the metal plate 300 as seen from the side of the support member (heater holder) 204. The metal plate 300 according to the present exemplary embodiment is longitudinally divided into two parts, metal plates 300*a* and 300*b*. The metal plates 300*a* and 300*b* are in contact with a surface of the heater 203 opposite to the surface of the heater 203 being in contact with the inner surface of the film 201. The metal plate 300*a* is 150 mm long, 5 mm wide, and 0.1 mm thick. The metal plate 300*b* is 90 mm long, 5 mm wide, and 0.1 mm thick. Diving the metal plate 300 in this way reduces the size of the metal plate 300 to suppress warpage, whereby the adhesion between the metal plate 300 and the heater 203 is improved. The metal plates 300*a* and 300*b* each include bent portions (not illustrated) which are formed by bending both longitudinal ends to the side where the heater holder 204 is placed. The bent portions are inserted into holes formed in the heater holder 204, whereby the longitudinal movement is restricted.

The metal plates 300*a* and 300*b* have asymmetrical shapes with respect to the central portion of the heat generation region. The metal plate 300*a* makes contact with the heater 203 longitudinally continuously from the central portion of the heat generation region (the region where the heat generation resistors 203*b* are placed) of the heater 203 to the end of the heat generation region which is on the side where the electrode portions 203*c* are provided. On the other hand, the metal plate 300*b* makes contact with the heater 203 longitudinally continuously from a position, which is spaced from the end of the metal plate 300*a* at a predetermined distance, to the end of the heat generation region which is on the side where the electrode portions 203*c* are not provided. The metal plate 300*a* is longitudinally arranged on the long shaft side of the pressure roller 202 illustrated in FIG. 6, and the metal plate 300*b* is longitudinally arranged on the short shaft side thereof. The metal plate 300 (aluminum plate) has a thermal conductivity (200 W/m·K) higher than the thermal conductivity (20 W/m·K) of the substrate 203*a* (alumina) of the heater 203. The metal plate 300 thus provides the effect of diffusing the heat of the heater 203.

As illustrated in FIG. 4, a thermistor Th serving as a temperature detection member is provided on the metal plate 300*a* in a position closer to the electrode portions 203*c* with respect to the central portion of the heat generation region. The thermistor Th is intended to detect the temperature of the heater 203 via the metal plate 300*a*. A control unit (not illustrated) controls the power supplied to the heater 203 so that the temperature detected by the thermistor Th coincides with a target temperature.

Next, a fixing processing operation of the fixing apparatus 7 according to the present exemplary embodiment will be described. The pressure roller 202 is rotated by the driving force transmitted from the driving source (not illustrated) via the gear G illustrated in FIG. 6. The film 201 is driven to rotate with the rotating pressure roller 202 by a frictional force received from the pressure roller 202 in the nip portion. At this time, electric power is supped from the power supply (not illustrated) to the heat generation resistors 203*b* via the electrode portions 203*c*. The heat generation resistors 203*b* generate heat, whereby the film 201 is heated. After the temperature of the thermistor Th reaches a target temperature allowing fixing, the fixing apparatus 7 performs the fixing processing for fixing a toner image to the recording material P by conveying the recording material P with the toner image formed thereon through the nip portion while heating the toner image by using the heat of the film 201.

Effect of Present Exemplary Embodiment

An effect of the present exemplary embodiment will be described by using the fixing apparatus 7 according to the present exemplary embodiment, and fixing apparatuses according to Comparative Examples 1 and 2. Here, configurations of Comparative Examples 1 and 2 will be described. The fixing apparatus according to Comparative Example 1 does not include the metal plate 300. In other respects, the configuration of Comparative Example 1 is similar to that of the present exemplary embodiment. The fixing apparatus according to Comparative Example 2 includes a metal plate 300 having a different shape from that of the metal plate 300 according to the present exemplary embodiment. In other respects, the configuration of Comparative Example 2 is similar to that of the present exemplary embodiment. The shape of the metal plate 300 according to Comparative Example 2 will be described with reference to FIG. 5. The metal plate 300 according to Comparative Example 2 is longitudinally divided into two metal plates 300*a* and 300*b*. The metal plates 300*a* and 300*b* have the same size (120 mm long, 10 mm wide, and 0.1 mm thick). The boundary portion between the metal plates 300*a* and 300*b* (region where the metal plate 300 is not in contact with the heater 203) is configured to longitudinally coincide with the central portion of the heat generation region of the heater 203. In other words, the metal plates 300*a* and 300*b* have symmetrical shapes with respect to the central portion of the heat generation region.

Figure 7:
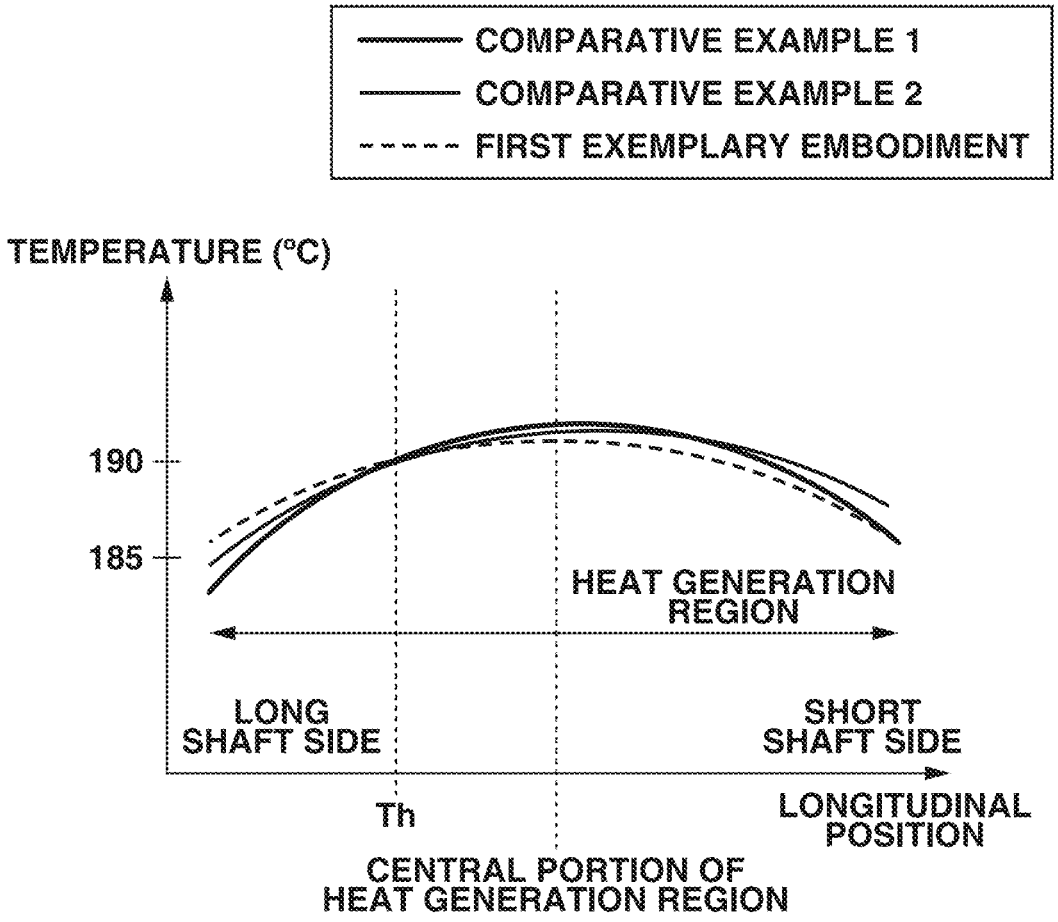
FIG. 7 is a graph illustrating film temperature distributions according to the first exemplary embodiment and Comparative Examples 1 and 2.

FIG. 7 and Table 1 illustrate measurement results of the surface temperature of the film 201 after the fixing processing is performed under the following conditions. The surface temperature of the film 201 was measured by using a noncontact thermometer (that can detect infrared rays to display a temperature distribution).

Type of recording material: XEROX Business 4200 (grammage 75 g/m$^2$, letter size)

Surface speed of the pressure roller 202 (process speed of the laser beam printer): 100 mm/s Target temperature: 190° C. (detection temperature of the thermistor Th)

Sheet passing condition: Pass 200 sheets continuously at intervals of one sheet per five seconds.

FIG. 7 is a graph illustrating the temperature distributions of the film 201 over the heat generation regions of the respective heaters 203 according to Comparative Examples 1 and 2 and the first exemplary embodiment. The horizontal axis of the graph illustrated in FIG. 7 indicates the longitudinal position of the film 201, and the vertical axis thereof indicates the temperature of the film 201. In FIG. 7, notations of the longitudinal position, long shaft side and short shaft side, are added to clarify the correspondence with the pressure roller 202.

Table 1 shows the measured temperatures of the central portion, the long shaft side, and the short shaft side of the heat generation region of the film 201 according to Comparative Examples 1 and 2 and the first exemplary embodiment. In Table 1, evaluations of the fixability of images after the fixing processing, good (○) or slightly poor (Δ), are shown with the measured temperatures.

TABLE 1

| | End on long shaft side | Central portion | End on short shaft side |
|---|---|---|---|
| First exemplary embodiment | 186° C. (○) | 190° C. (○) | 186° C. (○) |
| Comparative Example 1 | 183° C. (Δ) | 191° C. (○) | 186° C. (○) |
| Comparative Example 2 | 184° C. (Δ) | 191° C. (○) | 188° C. (○) |

As seen from FIG. 7, in all the fixing apparatuses, the temperature of the film 201 at the temperature detection position of the thermistor Th reaches the target temperature (190° C.). As illustrated in FIG. 7 and Table 1, in all the fixing apparatuses, the temperatures at both ends of the heat generation region of the film 201 are lower than the temperature of the central portion. The reason is that heat is taken from both longitudinal ends of the film 201 like the central portion when performing the fixing processing on large-sized recording materials such as letter-sized ones, and further the longitudinal ends, which are closer to the outside of the fixing apparatus, are more likely to dissipate heat than the central portion.

Comparative Example 1 shows that the temperature on the long shaft side of the film 201 (183° C.) is lower than that on the short shaft side (186° C.). The image subjected to the fixing processing by the fixing apparatus of Comparative Example 1 turned out to have poor fixability at the end on the long shaft side, as compared to the central portion and the end on the short shaft side. The reason is that the long shaft side of the shaft portion 202*a* of the pressure roller 202 is longer and has a higher heat capacity than the short shaft side, and accordingly the heat of the film 201 dissipates to the long shaft side more easily than to the short shaft side. In addition, the electrode portions 203*c* are provided on the substrate 203*a* on the long shaft side of the heater 203. Furthermore, the connector is connected to the electrode portions 203*c*. The long shaft side of the heater 203 therefore structurally has a higher heat capacity than that of the short shaft side, causing the heat of the film 201 to move more easily.

In Comparative Example 2, the temperature of the film 201 in the central portion of the heat generation region is lower and the temperatures at both ends thereof are higher than those in Comparative Example 1. The reason is that the heat near the central portion is transmitted to both ends having lower temperatures by the heat diffusion effect of the metal plates 300*a* and 300*b*. However, the image subjected to the fixing processing by the fixing apparatus of Comparative Example 2 has poorer fixability at the end on the long shaft side than in the central portion and at the end on the short shaft side. The temperature of the film 201 on the long shaft side (184° C.) is not sufficient.

In the first exemplary embodiment, the temperature of the film 201 on the long shaft side is 186° C. The fixability at the ends of the image is also favorable. The reason is that the fixing apparatus 7 according to the first exemplary embodiment includes the metal plate 300*a* that makes contact with the heater 203 continuously from the central portion of the heat generation region of the heater 203 to the end thereof on the long shaft side, and can therefore transfer the heat of the central portion more to the long shaft side than to the short shaft side. In contrast, in the fixing apparatus of Comparative Example 2, the central portion of the heat generation region coincides with the boundary area between the metal plates 300*a* and 300*b* in the longitudinal direction. In such a configuration, the heat in the central portion of the heater 203 is difficult to move to the ends via the metal plate 300. Moreover, in the configuration of Comparative Example 2, the metal plates 300*a* and 300*b* have longitudinally symmetrical shapes with respect to the central portion of the heat generation region. The metal plate 300 of Comparative Example 2 thus transfers approximately the same amount of heat of the central portion of the heater 203 to the end on the long shaft side and to the end on the short shaft side. It is therefore difficult to correct the heat generation distribution of the fixing apparatus that has a higher heat capacity on one longitudinal end than on the other longitudinal end.

As described above, the present exemplary embodiment provides the effect that in the fixing apparatus having a heat conduction member in contact with a heater, the heat conduction member can be divided without hindering the movement of heat by the heat conduction member between the central portion and the ends in the longitudinal direction.

Modification Examples of Present Exemplary Embodiment

Modification examples of the present exemplary embodiment will be described. In a modification example 1 of the present exemplary embodiment, the metal plates 300*a* and 300*b* have the same sizes as in the present exemplary embodiment, but are made of materials having different thermal conductivities. The metal plate 300*a* is a copper plate (with a thermal conductivity of 420 W/m·K). The metal plate 300*b* is an aluminum plate (200 W/m·K). Making the thermal conductivity of the metal plate 300*a* higher than that of the metal plate 300*b* provides the effect that the uneven temperature distribution of the film 201 due to an imbalance in heat capacity between the one and the other longitudinal ends of the fixing apparatus 7 can be corrected more easily than in the first exemplary embodiment.

As a modification example 2, the metal plate 300*b* may be configured as a copper plate (with a thermal conductivity of 420 W/m·K), and the metal plate 300*a* may be configured as an aluminum plate (200 W/m·K). In the present exemplary embodiment, the metal plate 300*b* is not in contact with the central portion of the heat generation region of the heater 203. Accordingly, the function of the metal plate 300*b* to move heat from the central portion to the end is poorer than that of the metal plate 300*a*. Thus, the thermal conductivity of the metal plate 300*b* can be made higher than that of the metal plate 300*a* to improve the function of the metal plate 300*b* to move the heat of the heater 203 from the central portion to the end.

Effects similar to those of the modification examples 1 and 2 can be obtained by changing the thicknesses or the transverse widths of the metal plates 300*a* and 300*b*, even with the metal plates 300*a* and 300*b* made of the same material.

In the present exemplary embodiment and the modification examples, the metal plate 300 is divided in two. However, the number of dividing the metal plate 300 is not limited thereto. Effects can be obtained even if the metal plate 300*b* is configured to be further divided into a plurality of parts. In the present exemplary embodiment and the modification examples, the long shaft side of the pressure roller 202, and the side where the electrode portions 203*c* of the heater 203 are provided are the same in the longitudinal direction. If the sides are located longitudinally opposite to each other, the metal plate 300*a* according to the present exemplary embodiment is arranged on the long shaft side of the pressure roller 202.

The present exemplary embodiment and the modification examples are not necessarily based on the assumption that there is an imbalance in heat capacity between the one and the other ends of the fixing apparatus 7. The present exemplary embodiment provides the effect of improving fixability at the ends by facilitating the movement of the heat of the central portion of the heater 203 to either of the ends when performing the fixing processing on a large-sized recording material.

In the present exemplary embodiment and the modification examples, metal plates (plate members made of metal) are used as heat conduction members. However, the heat conduction members are not limited thereto, and any members having a thermal conductivity higher than that of the substrate 203*a* of the heater 203 may be used. For example, plates and sheets made of graphite provide similar effects.

In the fixing apparatuses according to the present exemplary embodiment and the modifications examples, the heater 203 and the pressure roller 202 form the nip portion with the film 201 therebetween. However, the configuration is not limited thereto. For example, the fixing apparatus 7 may also be configured so that a heater makes contact with the inner surface of a film, and a pressure roller and a nip portion forming member different from the heater form a nip portion with the film therebetween. The fixing apparatus 7 may also be configured so that a film, a heater which makes contact with the inner surface of the film, and a fixing roller which forms a nip portion with a pressure roller are heated from outside.

Figure 8:
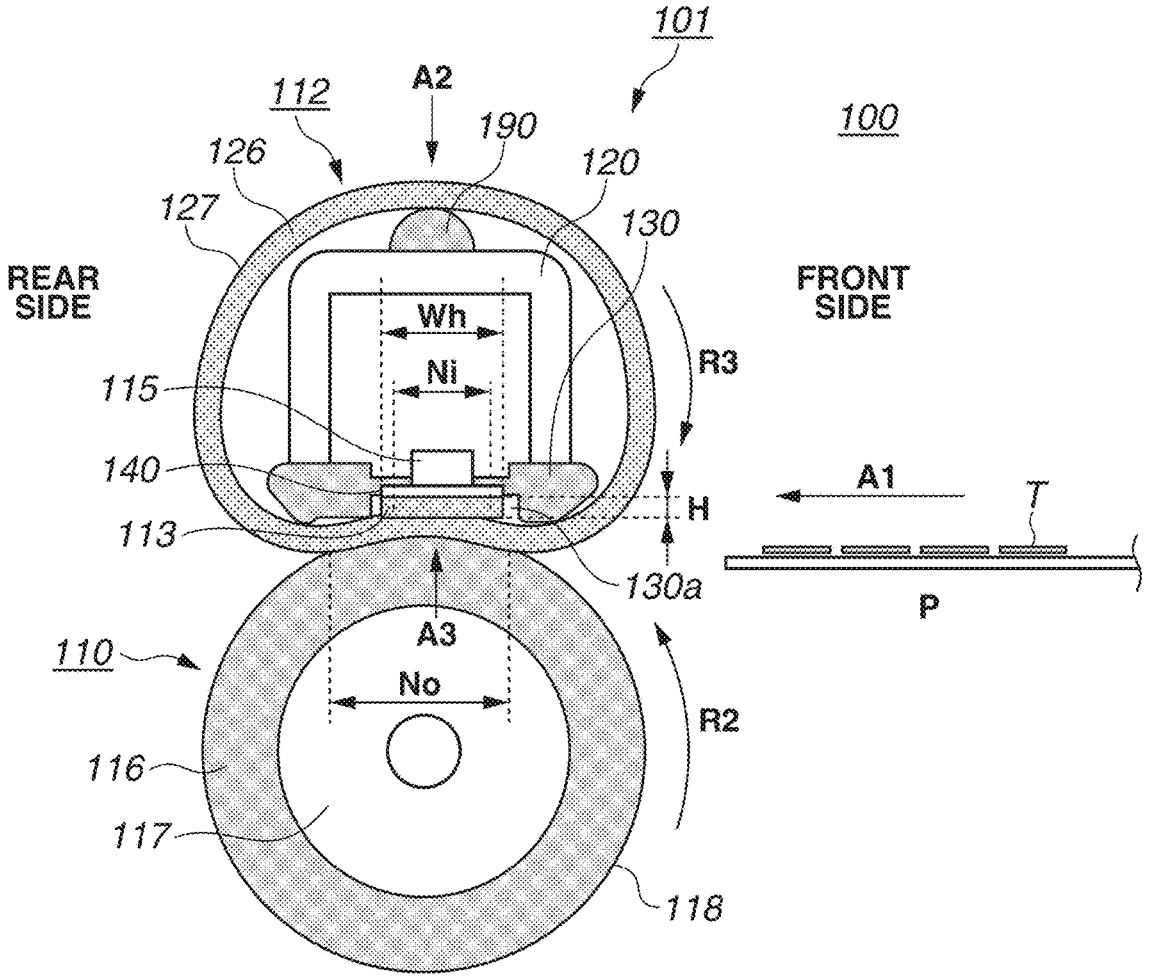
FIG. 8 is a schematic cross-sectional view of essential parts of a fixing apparatus according to a second exemplary embodiment.
Figure 9:
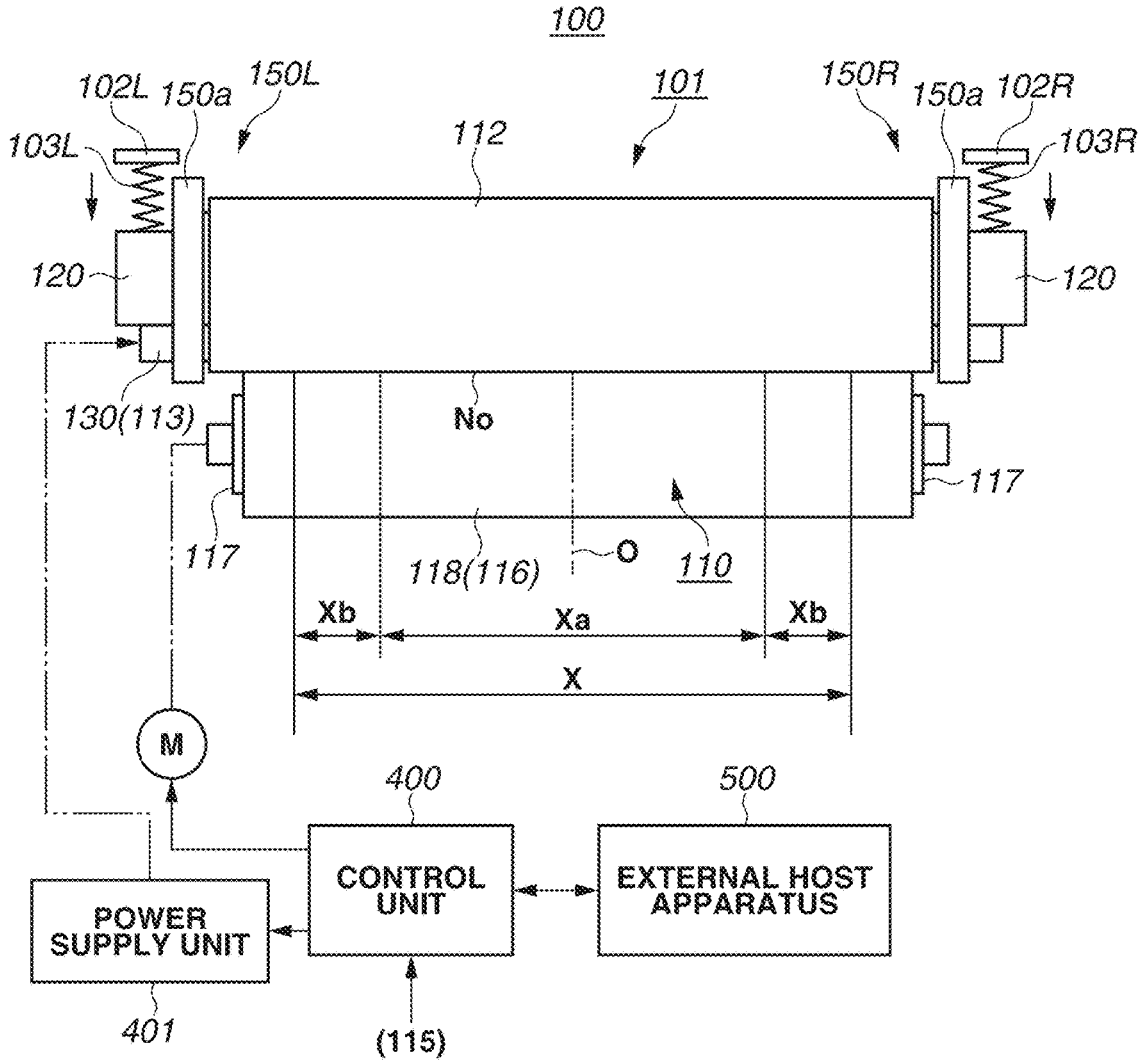
FIG. 9 is a schematic front view of the essential parts of the fixing apparatus according to the second exemplary embodiment.
Figure 10A:
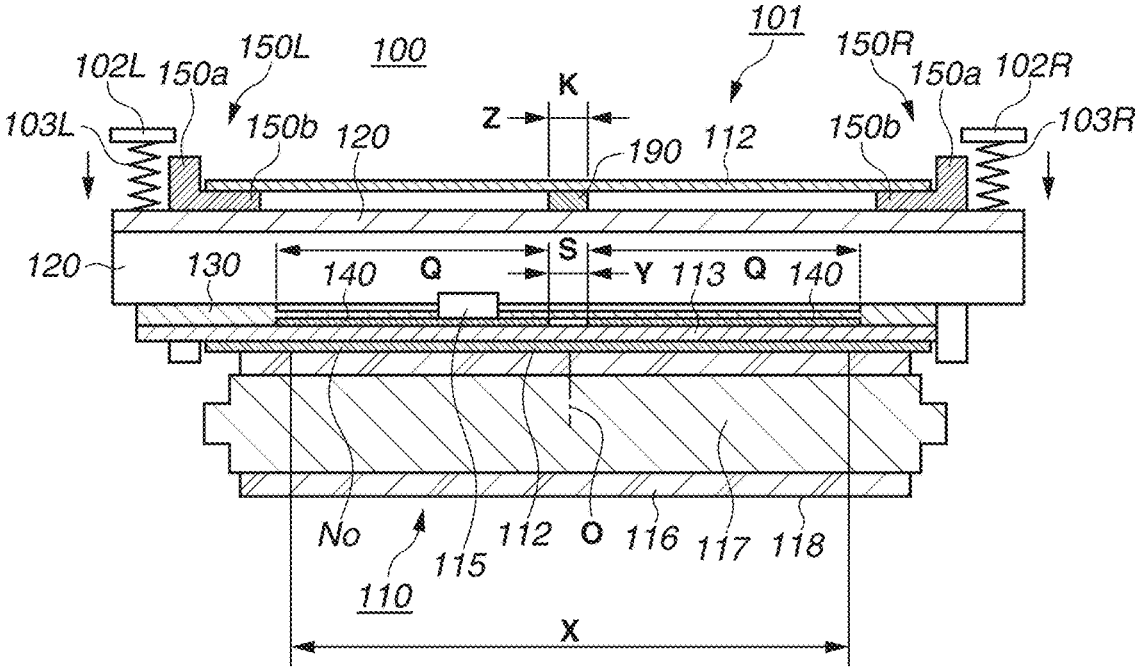
FIG. 10A is a schematic longitudinal sectional front view of the essential parts of the fixing apparatus according to the second exemplary embodiment.
Figure 10B:
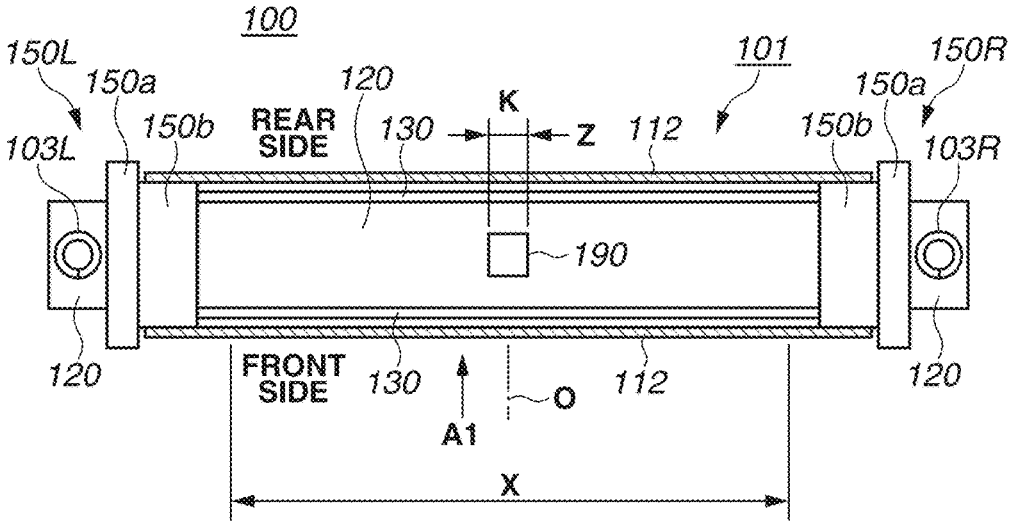
FIG. 10B is a schematic partly broken away view of the essential parts of the fixing apparatus according to the second exemplary embodiment.
Figure 11:
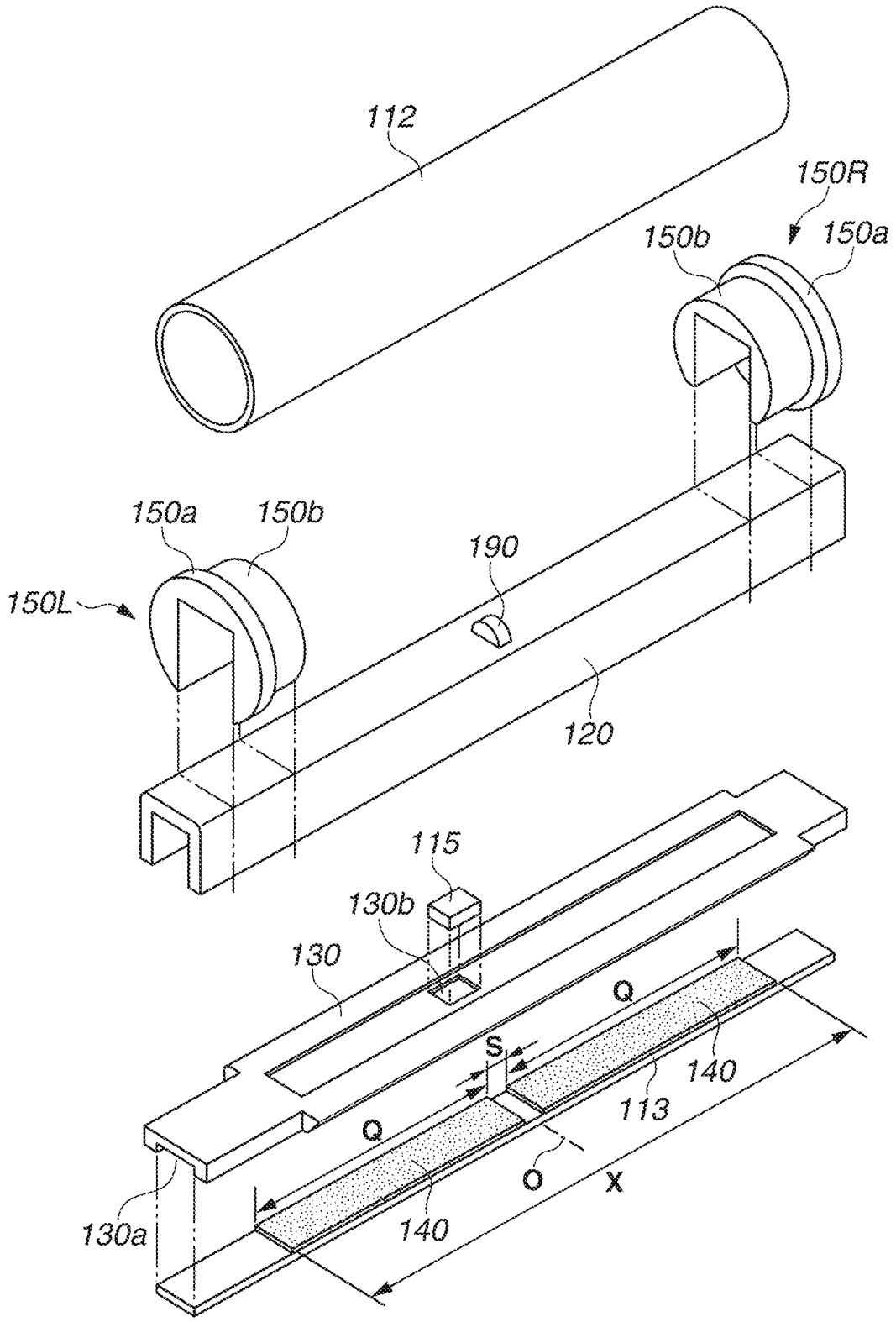
FIG. 11 is a schematic exploded perspective view of a film unit according to the second exemplary embodiment.

An image heating apparatus (fixing apparatus) according to a second exemplary embodiment will be described below. A fixing apparatus 100 according to the present exemplary embodiment is an image heating apparatus of film (belt) heating type which is intended to reduce its startup time and power consumption. FIG. 8 is a schematic cross-sectional view of essential parts of the fixing apparatus 100 according to the present exemplary embodiment. FIG. 9 is a schematic front view of the essential parts of the fixing apparatus 100 as seen in the direction indicated by an arrow A1 (sheet conveyance direction) illustrated in FIG. 8. FIG. 10A is a schematic longitudinal sectional front view of the essential parts of the fixing apparatus 100. FIG. 10B is a schematic partly broken away view (in which a fixing film 112 is broken away) of the essential parts of the fixing apparatus 100 as seen in the direction indicated by an arrow A2 illustrated in FIG. 8. FIG. 11 is a schematic exploded perspective view of a film unit 101.

As employed herein, a front side of the fixing apparatus 100 refers to the side where a sheet P is guided in. A rear side thereof refers to the opposite side. Left and right refer to the left (one end side) and right (the other end side) of the fixing apparatus 100 as seen from the front side of the fixing apparatus 100. An upstream side and a downstream side refer to the upstream side and the downstream side with respect to the sheet conveyance direction A1. The drawings schematically illustrate the fixing apparatus 100 and/or the components thereof, and do not correspond proportionally to the actual sizes of the components described herein.

The fixing apparatus 100 according to the present exemplary embodiment includes the film unit 101 that is horizontally long. The film unit 101 includes the cylindrical fixing film 112 having flexibility as an endless belt. An elastic pressure roller 110 is arranged substantially in parallel with the film unit 101. The pressure roller 110 serves as a rotating member that makes contact with an outer surface of the fixing film 112 to form a nip portion No.

The film unit 101 includes the foregoing fixing film 112, a heater 113 which serves as a heating member, a heater holder 130 which holds the heater 113, a stay 120 which supports the heater holder 130, and left and right flange members 150L and 150R.

The heater 113 is a ceramic heater which includes a long narrow substrate 2070 (see FIGS. 12A to 12C) and two parallel heat generation resistors 2010 and 2020 longitudinally formed on the substrate 2070. The heat generation resistors 2010 and 2020 generate heat when energized. The energization of the heat generation resistors 2010 and 2020 sharply increases the temperature of the heater 113. The heater 113 is fitted into and held by a groove hole 130*a* longitudinally formed in the heater holder 130, with a front side (first surface) including the heat generation resistors 2010 and 2020 outward.

It is desirable that the heater holder 130 be made of material having a low heat capacity to not take much heat from the heater 113. In the present exemplary embodiment, the heater holder 130 is made of LCP, which is a heat-resistant resin, in which glass balloons are included to lower the thermal conductivity and heat capacity. To provide a high strength, the heater holder 130 is supported by the iron stay 120 from the side opposite to the heater 113. The fixing film 112 is loosely fitted onto an assembly of the heater 113, the heater holder 130, and the stay 120 between the left and right flange members 150L and 150R.

The left and right flange members 150L and 150R are horizontally-symmetrical molded bodies of a heat-resistant, electrical insulating resin. The left and right flange members 150L and 150R are fitted, positioned, and fixed to predetermined positions at the left and right ends of the stay 120, respectively. The left and right flange members 150L and 150R each include a collar seat portion 150*a* serving as a first regulation portion for receiving an end of the fixing film 112. The left and right flange members 150L and 150R each further include an inner surface guide portion 150*b* serving as a second regulation portion. The inner surface guide portions 150*b* are internally fitted into the respective left and right ends of the fixing film 112. The film inner surface contact shape of the inner surface guide portions 150*b* in a film rotation direction is semicircular.

The pressure roller 110 is arranged with both ends of a core 117 rotatably supported between respective left and right side plates of an apparatus chassis (not illustrated) via bearing members. The film unit 101 is arranged substantially in parallel with the pressure roller 110 so that the heater 113 is opposed to the pressure roller 110.

The left and right ends of the stay 120 protrude from the left and right flange members 150L and 150R, respectively. Pressure springs 103L and 103R are arranged in a compressed manner between the left and right ends of the stay 120 and left and right spring seat portions 102L and 102R fixed on the apparatus chassis side, respectively. The stay 120 is pressed and biased toward the pressure roller 110 by a predetermined pressing force resulting from the compression reaction force of the pressure springs 103L and 103R.

By the pressing and biasing, the front surface (first surface) of the heater 113 held by the heater holder 130, and a part of the surface of the heater holder 130 are pressed into contact with the pressure roller 110 with the fixing film 112 therebetween, against the elasticity of an elastic layer 116 of the pressure roller 110.

As a result, the front side of the heater 113 makes contact with the inner surface of the fixing film 112 to form an inner surface nip Ni for heating the fixing film 112 from the inner surface. The pressure roller 110 is pressed into contact with the heater 113 with the fixing film 112 therebetween, whereby the fixing nip (nip portion) No having a predetermined width in the sheet conveyance direction A1 is formed between the outer surface of the fixing film 112 and the pressure roller 110.

The pressure roller 110 receives a driving force of a motor (rotation unit) M controlled by a control unit 400 via a power transmission mechanism (not illustrated), and is thereby driven to rotate in the counterclockwise direction indicated by an arrow R2 illustrated in FIG. 8 at a predetermined speed. In the present exemplary embodiment, the pressure roller 110 rotates at a surface moving speed of 200 mm/sec.

As the pressure roller 110 is driven to rotate, the fixing film 112 is driven to rotate around the assembly of the heater 113, the heater holder 130, and the stay 120 in the clockwise direction indicated by an arrow R3 illustrated in FIG. 8, with its inner peripheral surface making contact with and sliding over the surface of the heater 113 in the fixing nip No. To smooth the rotation of the fixing film 112, a lubricant (grease) can be interposed between the surfaces of the heater 113 and the heater holder 130 and the inner surface of the fixing film 112.

The collar seat portions 150*a* of the left and right flange portions 150L and 150R receive the respective ends of the fixing film 112 to regulate a siding movement of the fixing film 112 in the horizontal direction (width direction) resulting from the rotation. The inner surface guide portions 150*b* support both ends of the fixing film 112 from the inner surface of the fixing film 112, thereby supporting the rotation of the fixing film 112 (determining the rotation trajectory).

As will be described below, the heater 113 is sharply heated by the heat generation of the energized heat generation resistors 2010 and 2020, and raised and adjusted to a predetermined temperature. In a state where the pressure roller 110 is driven to rotate and the heater 113 is raised and adjusted to the predetermined temperature, the sheet P on which an unfixed toner image T is formed by an image forming unit is guided into the fixing nip No with the image surface facing the fixing film 112.

The sheet P is then nipped by and conveyed through the fixing nip No. In the fixing nip No, the sheet P is heated and pressed by the heat of the fixing film 112 heated by the heater 113 and the nipping pressure, whereby the unfixed toner image T is fixed to the sheet P as a fixed image.

A sheet passing region of a large-sized sheet will be denoted by X. In the fixing apparatus 100 according to the present exemplary embodiment, sheets having various width sizes, from large to small, are passed with respect to a sheet width center, which is the so-called center reference conveyance. A central reference line (imaginary line) will be denoted by O. A sheet passing region (sheet passing portion, passing portion) of a small-sized sheet will be denoted by Xa. A difference region ((X−Xa)/2) with respect to the sheet passing region X of a large-sized sheet when a small-sized sheet is passed will be referred to as a non-sheet passing region (non-sheet passing portion, non-passing portion) Xb. Both ends of the fixing film 112 are regulated by the collar seat portions 150*a* of the respective flange members 150L and 150R from the inner surfaces of the collar seat portions 150*a*, on the outside of the sheet passing region X.

(Pressure Roller)

The pressure roller 110 according to the present exemplary embodiment has an outer diameter of φ20 mm. The elastic layer 116 (foamed rubber) having a thickness of 4 mm and made of foamed silicone rubber is formed around the iron core 117 of φ12 mm. If the pressure roller 110 has a high heat capacity and a high thermal conductivity, the heat of the surface of the pressure roller 110 is easily absorbed into the interior to make the surface temperature difficult to increase. Thus, using a material having a minimum heat capacity, a minimum thermal conductivity, and a high thermal insulation effect can reduce the startup time of the surface temperature of the pressure roller 110.

The foregoing foamed rubber made of foamed silicone rubber has a thermal conductivity of 0.11 to 0.16 W/m·K, which is lower than the thermal conductivity of solid rubber, which is approximately 0.25 to 0.29 W/m·k. A specific gravity is related to the heat capacity. The solid rubber has a specific gravity of approximately 1.05 to 1.30. The foamed rubber has a specific gravity of approximately 0.45 to 0.85, and thus has a low heat capacity. The foamed rubber can thus reduce the startup time of the surface temperature of the pressure roller 110.

Although a smaller outer diameter of the pressure roller 110 can reduce more heat capacity, too small an outer diameter narrows the width of the fixing nip No. An appropriate diameter is thus required. In the present exemplary embodiment, the outer diameter is set to φ20 mm. The elastic layer 116 also needs to have an appropriate thickness because too small a thickness dissipates the heat of the metal core 117. In the present exemplary embodiment, the thickness of the elastic layer 116 is set to 4 mm.

A release layer 118 made of perfluoroalkoxy resin (PFA) is formed on the elastic layer 116 as a toner release layer. Like a release layer 127 of the fixing film 112 to be described below, the release layer 118 may be a cladding tube or a surface coating of coating material. In the present exemplary embodiment, a high-durability tube is used. As the material of the release layer 118 aside from PFA, fluorine resins such as polytetrafluoroethylene (PTFE) and tetrafluoroethylene-hexafluoropropylene resin (FEP) may be used. Alternatively, fluorine-containing rubber or silicone rubber having high releasability may be used.

Although a lower surface hardness of the pressure roller 110 can secure the width of the fixing nip No at lower pressure, too low a surface hardness lowers durability. In the present exemplary embodiment, the surface hardness of the pressure roller 110 is set to 40° in Asker-C hardness (under a load of 4.9 N).

(Fixing Film)

The fixing film 112 according to the present exemplary embodiment is a flexible heat-resistant member that forms a thin, substantially cylindrical shape having an outer diameter of φ20 mm by its own elasticity while the fixing film 112 is in a free state without deformation by external force. The fixing film 112 has a multilayered configuration in the thickness direction. The layer configuration of the fixing film 112 includes a base layer 126 for maintaining the strength of the fixing film 112 and the release layer 127 for reducing the adhesion of stain to the surface.

The base layer 126 undergoes the heat of the heater 113 and thus needs to be made of heat-resistant material. The material also requires a high strength since the base layer 126 slides over the heater 113. It is thus desirable to use metal such as SUS and nickel, or heat-resistant resin such as polyimide. As compared to resin, metal has a higher strength and thus can be formed thinner. Metal has also a higher thermal conductivity, which thereby facilitates the transmission of the heat of the heater 113 to the surface of the fixing film 112.

As compared to metal, resin has a lower specific gravity, which thereby provides the advantage of a lower heat capacity for quick heating. In addition, resin can be molded into a thin film by coating and thus can be molded at low cost. In the present exemplary embodiment, polyimide resin is used as the material of the base layer 126 of the fixing film 112. Carbon-type fillers are added thereto to improve the thermal conductivity and strength. The thinner the base layer 126 is, the more easily the heat of the heater 113 is transmitted to the surface of the fixing film 112. However, the strength decreases with the decrease in thickness. It is thus desirable to set the thickness of the base layer 126 to approximately 15 μm to 100 μm. In the present exemplary embodiment, the base layer 126 has a thickness of 50 μm.

It is desirable that the release layer 127 of the fixing film 112 be made of fluorine resin such as PFA, PTFE, and FEP. In the present exemplary embodiment, PFA, which has excellent releasability and heat resistance among the fluorine resins, is used.

The release layer 127 may be a cladding tube or a surface coating of coating material. In the present exemplary embodiment, the release layer 127 is molded by coating which is excellent for thin molding. The thinner the release layer 127 is, the more easily the heat of the heater 113 is transmitted to the surface of the fixing film 112. However, too small a thickness lowers durability. It is desirable that the thickness of the release layer 127 be approximately 5 μm to 30 μm. In the present exemplary embodiment, the release layer 127 has a thickness of 10 μm.

(Heater)

The heater 113 according to the present exemplary embodiment is a typical heater used in a heating apparatus of film heating type. The one having heat generation resistors provided in series on a ceramic substrate is used.

Figure 12A:
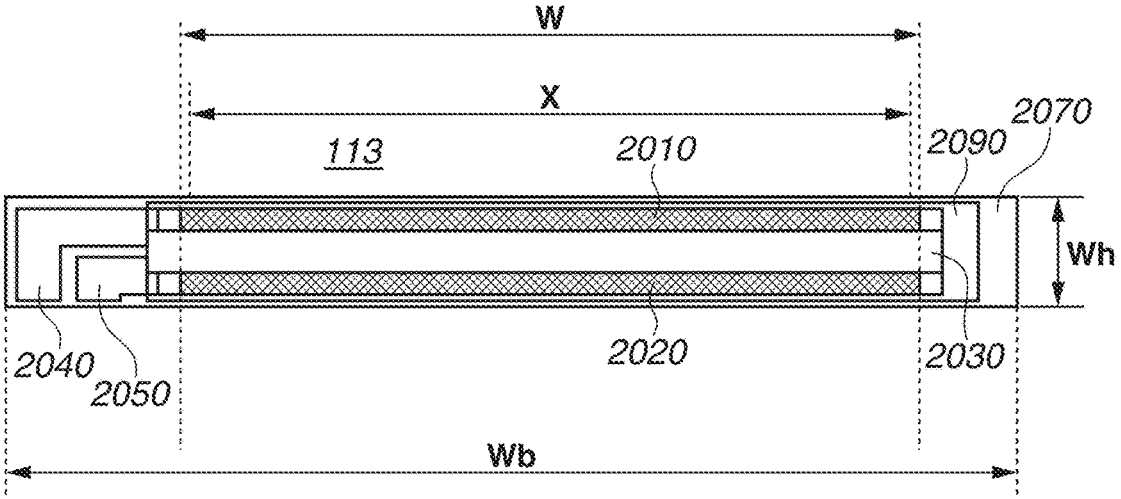
FIGS. 12A, 12B, and 12C illustrate a configuration of a heater according to the second exemplary embodiment.
Figure 12B:
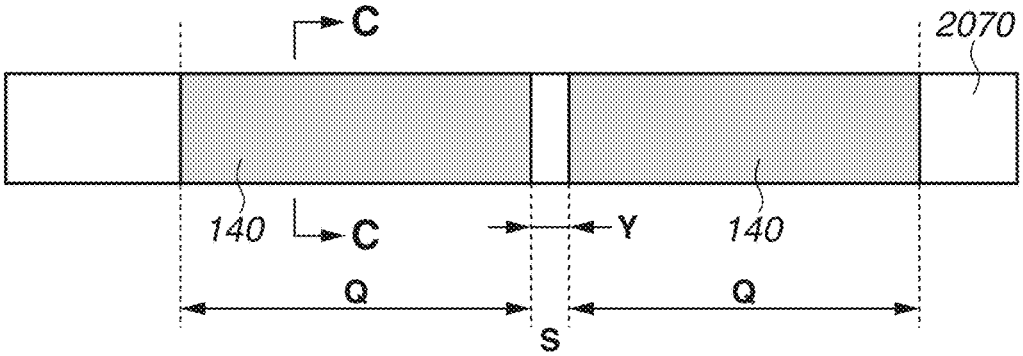
Figure 12C:
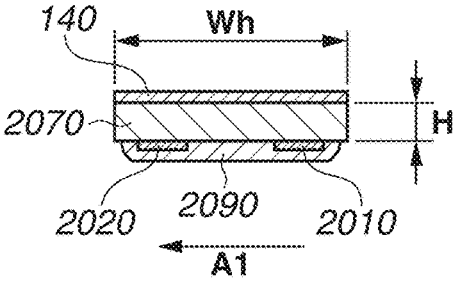

FIG. 12A schematically illustrates the front side (first surface) of the heater 113 according to the present exemplary embodiment (which is a schematic view of the heater 113 as seen in the direction indicated by an arrow A3 illustrated in FIG. 8). FIG. 12B schematically illustrates the back side (second surface) of the heater 113 according to the present exemplary embodiment (which is a schematic view of the heater 113 as seen in the direction indicated by the arrow A2 illustrated in FIG. 8). FIG. 12C is a schematic enlarged cross-sectional view taken along a line c-c illustrated in FIG. 12B.

The heater 113 uses, as the substrate 2070, a long narrow alumina plate having a longitudinal width Wb of 270 mm, a width Wh of 6 mm in the sheet conveyance direction A1, and a thickness H of 1 mm. Two 10-μm-thick parallel heat generation resistors 2010 and 2020 of Ag/Pd are longitudinally formed on the surface of the substrate 2070 by screen printing. The substrate 2070 and the heat generation resistors 2010 and 2020 are covered by 50-μm thick glass as a protection layer 2090.

A sheet of maximum width size (large-sized sheet) conveyable by the fixing apparatus 100 according to the present exemplary embodiment has the letter-size width of 216 mm. In the present exemplary embodiment, the width of the sheet passing region X for a large-sized sheet is thus the letter-size width of 216 mm. The two parallel heat generation resistors 2010 and 2020 have a longitudinal width W of 218 mm, which is 1 mm longer than the letter-size with of 216 mm on each side so that the letter-size width of 216 mm can be sufficiently heated.

The heat generation resistors 2010 and 2020 on the substrate 2070 are arranged in series via a conductor 2030 at the end on one end side, and covered by the protection layer 2090. The ends of the heat generation resistors 2010 and 2020 on the other end side are provided with conductive electrodes 2040 and 2050, respectively. A power supply unit 401 is connected to the electrodes 2040 and 2050 via a connector (not illustrated).

If the electrodes 2040 and 2050 are energized by the power supply unit 401, the heat generation resistors 2010 and 2020 generate heat across the entire width W. As a result, a heater length region portion corresponding to the entire width W of the heat generation resistors 2010 and 2020 including the sheet passing region X of a large-sized sheet is sharply heated.

A temperature detection element 115 for detecting the temperature of the substrate 2070 raised by the heat generation of the heat generation resistors 2010 and 2020 is arranged on the back side of the heater 113 (back side of the substrate 2070).

The temperature detection element 115 detects a substrate temperature of a heater portion which is a region where sheets of any width, from large to small, are passed. In the present exemplary embodiment, the temperature detection element 115 is inserted into a hole portion 130*b* (see FIG. 11) formed in the holder 130, and put in contact with the back side of the substrate 2070 of the heater 113 held by the holder 130 via a heat conduction member 140 (described below) arranged on the back side of the substrate 2070. In other words, the temperature detection element 115 detects the temperature of the heater 113 via the heat conduction member 140.

The temperature detection element 115 inputs a detection signal related to the temperature of the heater 113 to the control unit 400. The control unit 400 appropriately controls the amount of current (power) for the power supply unit 401 to pass through the heat generation resistors 2010 and 2020 of the heater 113 so that the detection signal related to the temperature of the heater 113, input from the temperature detection element 115, is maintained to a signal corresponding to a predetermined fixing temperature. In other words, the temperature of the heater 113 is adjusted to the predetermined fixing temperature.

(Heat Conduction Members)

Heat conduction members 140 for longitudinally uniformizing the longitudinal temperature of the heater 113 are arranged on the back side of the heater 113 (back side of the substrate 2070) according to the present exemplary embodiment. The higher the thermal conductivity of the material of the heat conduction member 140 is than that of the substrate 2070 of the heater 113, the higher the effect of uniformizing the temperature of fixing members such as the heater 113, the fixing film 112, and the pressure roller 110 is. The heat conduction members 140 may be formed by the application of a silver paste having a high thermal conductivity. Alternatively, graphite sheets or metal plates such as an aluminum plate may be provided as the heat conduction members 140.

The use of sheets or metal plates as the heat conduction members 140 has the advantage that the heat capacity of the heat conduction members 140 can be easily adjusted by changing the thickness. In the present exemplary embodiment, aluminum plates having a relatively high thermal conductivity and available at low price among metals are used as the heat conduction members 140. The thicker the heat conduction members 140 are, the higher the effect of uniformizing temperature is. This improves the productivity of the sheet fixing processing in continuously passing small-sized sheets.

However, the greater thickness increases the heat capacity, and lengthens the startup time of the heater 113. Thus, the material and thickness of the heat conduction members 140 need to be adjusted in terms of the balance between the productivity of sheets P and the startup time of the heater 113. In the present exemplary embodiment, aluminum plates having a thickness of 0.5 mm and a transverse width of 6 mm, which is the same as the width Wh of the heater 113, are used as the heat conduction members 140.

The substrate 2070 of the heater 113, or alumina, and the heat conduction members 140, or aluminum, have different coefficients of thermal expansion. Repeating a heat cycle of heating and cooling can thus sometimes cause deformation of the heat conduction members 140. The heat conduction members 140 according to the present exemplary embodiment are therefore configured to be divided in two at the central portion in the longitudinal portion.

The greater the number of longitudinally dividing the heat conduction members 140 is, the smaller the longitudinal width of each of the parts obtained by dividing the heat conduction member 140 is and the smaller the thermal expansion is. This makes deformation due to the heat cycle less likely to occur. However, the greater number of divisions reduces the effect of longitudinally uniformizing the heat of the heater 113. In particular, in the case of continuously passing small-sized sheets as described above, to uniformize the temperature of the non-sheet passing portions Xb (see FIG. 9) in the longitudinal direction of the heater 113, the heat conduction members 140 need to be arranged across the non-sheet passing potions Xb and the sheet passing portion Xa. In the present exemplary embodiment, as illustrated in FIG. 12B, the heat conduction members 140 are provided by dividing a heat conduction member in two in the longitudinal central portion.

As illustrated in FIG. 12B, the heat conduction members 140 are provided by dividing a heat conduction member in two in the longitudinal central portion, with a division distance Y therebetween. The division distance Y is set so that the heat conduction members 140 do not make contact with each other when thermally expanded. In the present exemplary embodiment, the division distance Y is set to 5 mm.

The greater the longitudinal width of the heat conduction members 140 is, the higher the effect of longitudinally uniformizing the heat is. However, this facilitates the dissipation of the heat at the ends when a large-sized sheet is passed, and the fixability at the ends of the large-sized sheet in the width direction may deteriorate. Thus, in the present exemplary embodiment, the longitudinal width (the positions of the left and right ends) of the heat conduction members 140 is thus set to be the same as the longitudinal with W of the heat generation resistors 2010 and 2020 of the heater 113.

As illustrated in FIG. 8, the heater 113 and the heat conduction members 140 are fitted into and held by the groove hole 130*a* formed in the heater holder 130.

Here, in the direction orthogonal to the conveyance direction A1 of the sheet P in the plane of the conveyance path of the sheet P, the regions where the heat conduction members 140 are in contact with the heater 130 within the sheet passing region (passing region) X of a large-sized sheet will be referred to as first regions Q. Further, the division separation region where the heat conduction members 140 are not in contact with the heater 113 will be referred to as a second region S. The first regions Q are wider than the second region S.

Figure 21A:
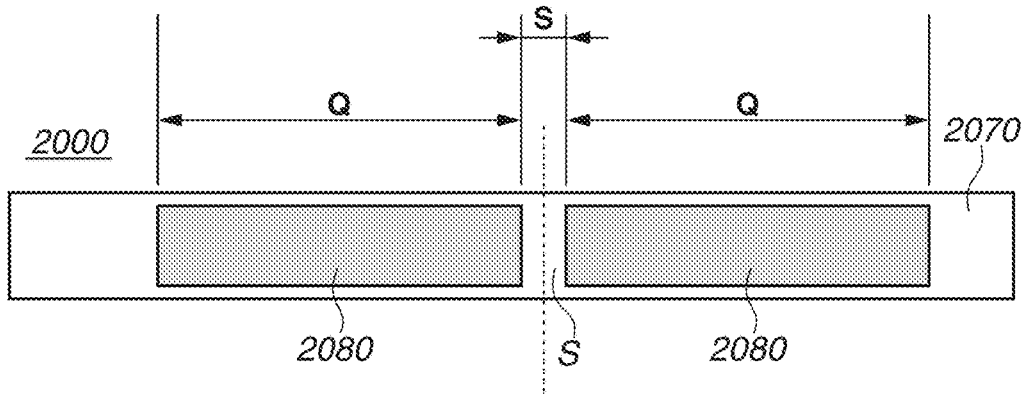
FIGS. 21A and 21B illustrate variations in temperature of a fixing film in a longitudinal direction in the case of dividing a heat conduction member into parts.
Figure 21B:
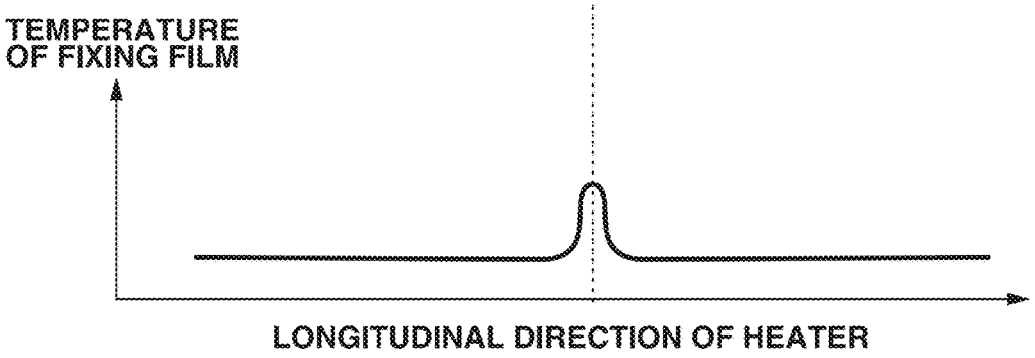

A problem to be solved in the present exemplary embodiment will be described with reference to FIGS. 21A and 21B. As illustrated in FIGS. 21A and 21B, if a plurality of parts (heat conduction members 2080) obtained by longitudinally dividing a heat conduction member is configured to be arranged on the back side of a heater 2000, the following phenomenon can occur.

FIG. 21A schematically illustrates a configuration where the heat conduction members 2080 are provided by dividing a heat conduction member in two in the longitudinal central portion. The heat conduction members 2080 obtained by the division make contact with the back side of the heater 2000 in the first regions Q. There is also a separation portion S between the heat conduction members 2080. The separation portion S is the second region S where the heat conduction members 2080 are not in contact with the back side of the heater 2000. In this case, variations in the temperature of the fixing film 112 in the longitudinal direction may occur between the first regions Q and the second region S, causing an image defect such as gloss unevenness in a fixed image. Such gloss unevenness significantly occurs particularly when the heater 2000 is started up in a state where the heat conduction members 2080 are cold (in a cold state).

FIG. 21B is a graph illustrating valuations in the temperature of the fixing film 112 when the fixing apparatus 100 using the heater 2000 configured with the heat conduction members 2080 (obtained by dividing a heat conduction member) illustrated in FIG. 21A is started up in the cold state. As illustrated in FIG. 21B, the portion of the heater 2000 corresponding to the second region S in the longitudinal direction of the heater 2000 has a higher temperature than that of the portions of the heater 2000 corresponding to the first regions Q because the heat conduction members 2080 do not take heat from the portion corresponding to the second region S.

Consequently, the portion of the fixing film 112 and the portion of the pressure roller 110 corresponding to the second region S of the heater 2000 also become high in temperature. This can increase the gloss of the portion of the fixed image corresponding to the second region S to produce an image that includes a gloss streak in the vertical direction (sheet conveyance direction).

(Contact Member of Fixing Film)

Next, a contact member for the endless belt (fixing film) 112, which is a characteristic configuration of the present exemplary embodiment for solving the foregoing problem, will be described. The fixing apparatus 100 according to the present exemplary embodiment includes a contact member 190 which makes contact with the inner surface of the fixing film 112. The region where the contact member 190 makes contact with the fixing film 112 will be referred to as a third region K. The contact member 190 is arranged in a position corresponding to the second region S of the heater 113 in the circumferential direction of the fixing film 112. The third region K includes at least the second region S. In the present exemplary embodiment, a width Z of the third region K is approximately the same as the width Y of the second region S.

As illustrated in FIGS. 10A and 10B, the heat conduction members 140 are provided by dividing a heat conduction member in two in the longitudinal central portion, with the division distance Y (the width Y of the second region S) therebetween. The contact member 190 for making contact with the inner surface of the fixing film 112 is configured to be arranged in a position corresponding to the second region S where the heat conduction members 140, obtained by the dividing a heat conduction member, are not in contact with the heater 113 in the circumferential direction of the fixing film 112.

The contact member 190 according to the present exemplary embodiment is made of LCP, the same heat-resistant resin as the material of the heater holder 130. The contact member 190 is arranged on top of the iron stay 120 and configured to constantly make contact with and slide over the inner surface of the rotating fixing film 112.

In the configuration where the heat conduction members 140 are provided by longitudinally dividing a heat conduction member but the foregoing contact member 190 is not provided, the second region S where the heat conduction members 140 are not in contact with the back side of the heater 2000 become high in temperature if the heater 2000 of the fixing apparatus 100 is started up in the cold state. This causes variations in the temperature of the fixing film 112 in the width direction (longitudinal direction) (see FIG. 21B).

On the other hand, in the configuration according to the present second exemplary embodiment, the contact member 190 for making contact with the inner surface of the fixing film 112 is arranged in the position corresponding to the second region S in the circumferential direction of the fixing film 112. Consequently, the contact member 190 can lower the high temperature of the fixing film 112 in the position corresponding to the second region S to reduce variations in the temperature of the fixing film 112 in the longitudinal direction.

Further, in the configuration according to the present exemplary embodiment, when the fixing apparatus 100 enters a hot state, the contact member 190 of the fixing film 112 also increases in temperature. As a result, although the contact member 190 is in contact with the inner surface of the fixing film 112, the contact member 190 is less likely to take heat from the fixing film 112. This makes variations in the temperature of the fixing film 112 less likely to occur even in the hot state. In the configuration according to the present exemplary embodiment, variations in the temperatures of the fixing film 112 and the pressure roller 110 in the longitudinal direction are less likely to occur throughout the cold to hot states of the fixing apparatus 100.

More specifically, in the configuration where the heater 113 is provided with the heat conduction members 140, obtained by dividing a heat conduction member, the contact member 190 is put in contact with a portion of the fixing film 112 corresponding to the second region S of the heater 113 in the circumferential direction of the fixing film 112. This can suppress the occurrence of variations in the temperatures of the fixing film 112 and the pressure roller 110 throughout the cold to hot states of the fixing apparatus 100.

(Verification of Effect)

The configuration including the contact member 190 according to the present exemplary embodiment and configurations of Comparative Examples without the contact member 190 were compared in terms of the occurrence of gloss unevenness due to temperature valuations in the longitudinal direction.

As the configurations of Comparative Examples, the following configurations 1) and 2) were used:

1) the contact member 190 is not provided 2) the contact member 190 is not provided, and the amount of heat generated by the heat generation resistors 2010 and 2020 is suppressed in the portion of the heater 113 corresponding to the second region S.

When a print image having a uniform pattern over the entire surface is printed, gloss unevenness is noticeable more easily. In particular, when a solid image using a large amount of toner is printed, gloss unevenness is likely to occur. The heater 113 was started up in the cold state where the fixing apparatus 100 was cold. Solid full images, and halftone full images having a printing ratio of 50% were alternately printed on 50 sheets for each, and a total of 100 images were checked for gloss unevenness.

Table 2 shows the comparison result, in which the fixed images causing gloss unevenness in a location corresponding to the second region S of the heater 113 are evaluated as x, and the fixed images causing no gloss unevenness are evaluated as ○.

TABLE 2

| Cold state ---> Hot state | | | | | | |
|---|---|---|---|---|---|---|
| | | Image pattern | 1st to 5th images | 6th to 10th images | 11th to 20th images | 21st to 50th images |
| Configurations of Comparative Examples | 1) Normal heater | Solid image | x | x | ○ | ○ |
| | | Halftone image | x | ○ | ○ | ○ |
| | 2) Heater with suppressed amount of heat generation | Solid image | ○ | ○ | x | x |
| | | Halftone image | ○ | ○ | ○ | x |
| Configuration according to second exemplary embodiment | | Solid image | ○ | ○ | ○ | ○ |
| | | Halftone image | ○ | ○ | ○ | ○ |

In the configuration 1) of Comparative Examples using a normal heater, if the fixing apparatus 100 is in the cold state where the heat conduction members 140 have not been warmed yet as described above, the heat of the heater 113 dissipates to the heat conduction members 140 in the portions corresponding to the first regions Q of the heater 113. This results in a temperature variation in the portion corresponding to the second region S of the heater 113.

Consequently, gloss unevenness occurred in the first to fifth solid images, and the first to fifth halftone images having the lower printing ratio. When the number of printed images increased and the fixing apparatus 100 entered the hot state where the heat conduction members 140 were warmed up, the heat of the heater 113 stopped dissipating to the heat conduction members 140 in the first regions Q, and gloss unevenness disappeared.

In the configuration 2) of Comparative Examples, which suppresses the amount of heat generation by the heat generation resistors 2010 and 2020 in the portion corresponding to the second region S, there were no temperature variations in the longitudinal direction, resulting in no gloss unevenness in the cold state. As the number of printed images increased and the fixing apparatus 100 entered the hot state where the heat conduction members 140 were warmed up, gloss unevenness occurred due to an insufficient amount of heat generation in the second region S.

On the other hand, in the configuration according to the present second exemplary embodiment, the occurrence of gloss unevenness due to temperature variations in the longitudinal direction was not observed throughout the cold to hot states even in the solid images.

In the configuration according to the present second exemplary embodiment, the contact member 190 for making contact with the inner surface of the fixing film 112 is arranged in the position corresponding to the second region S of the heater 113 in the circumferential direction of the fixing film 112. As a result, variations in the temperatures of the fixing film 112 and the pressure roller 110 can be prevented regardless of the degree to which the fixing apparatus 100 is warmed, and an image defect due to gloss unevenness can be suppressed.

In the configuration according to the present exemplary embodiment, the heat-resistant resin LCP is used as the material of the contact member 190. However, this is not restrictive.

According to the temperature rise of the second region S of the heater 113, the amount of heat absorption of the contact member 190 can be adjusted by changing the shape and/or the thermal conductivity of the contact member 190. For example, if the input power of the heater 113 is high and the second region S of the heater 113 increases in temperature very quickly, the contact member 190 can be modified to easily take heat from the portion of the fixing film 112 corresponding to the second region S. For example, heat can be easily taken from the fixing film 112 by improving the surface properties of the contact member 190, or increasing the contact pressure of the contact member 190 with the fixing film 112.

The contact member 190 may be made of material having a high heat conductivity to make adjustments to easily take heat from the contact portion of the fixing film 112 and increase the heat capacity.

For example, the contact member 190 may be made of the same metal as the material of the heat conduction members 140 (aluminum in the present exemplary embodiment) so that the portions of the fixing film 112 corresponding to the first regions Q and the second region S of the heater 113 similarly rise in temperature. Variations in the temperature of the fixing film 112 may be made uniform by such an adjustment.

Contact members 190 may be provided in a plurality of positions in the circumferential direction of the fixing film 112. The contact member 190 may be made larger to increase the contact area to take heat more easily.

As described above, the amount of heat to be released from the fixing film 112 is optimized by adjusting the contact state, shape, and material (thermal conductivity or heat capacity) of the contact member 190 according to the temperature rise of the portion of the fixing film 112 corresponding to the second region S of the heater 113. By such adjustments, variations in the temperature of the fixing film 112 in the longitudinal direction can be eliminated.

A third exemplary embodiment will be described below. In the present exemplary embodiment, support members (guide members) for making contact with the inner surface of the fixing film 112 to support the rotation of the fixing film 112 from the inner surface are arranged in a position corresponding to the second region S of the heater 113 in the circumferential direction of the fixing film 112. In other words, the support members also function as contact members. As a result, variations in the temperature of the fixing film 112 in the width direction (longitudinal direction) can be prevented to suppress the occurrence of gloss unevenness. The description thereof will be given below.

Similarly to the foregoing second exemplary embodiment, in the present exemplary embodiment, the image forming apparatus for forming an unfixed toner image is an ordinary one. The description thereof will be thus omitted. A fixing apparatus 100 according to the present exemplary embodiment is an image heating apparatus of film heating type having a basic configuration similar to that of the fixing apparatus 100 according to the second exemplary embodiment. Similar members are designated by the same reference numerals. The description thereof will be thus omitted.

Figure 13A:
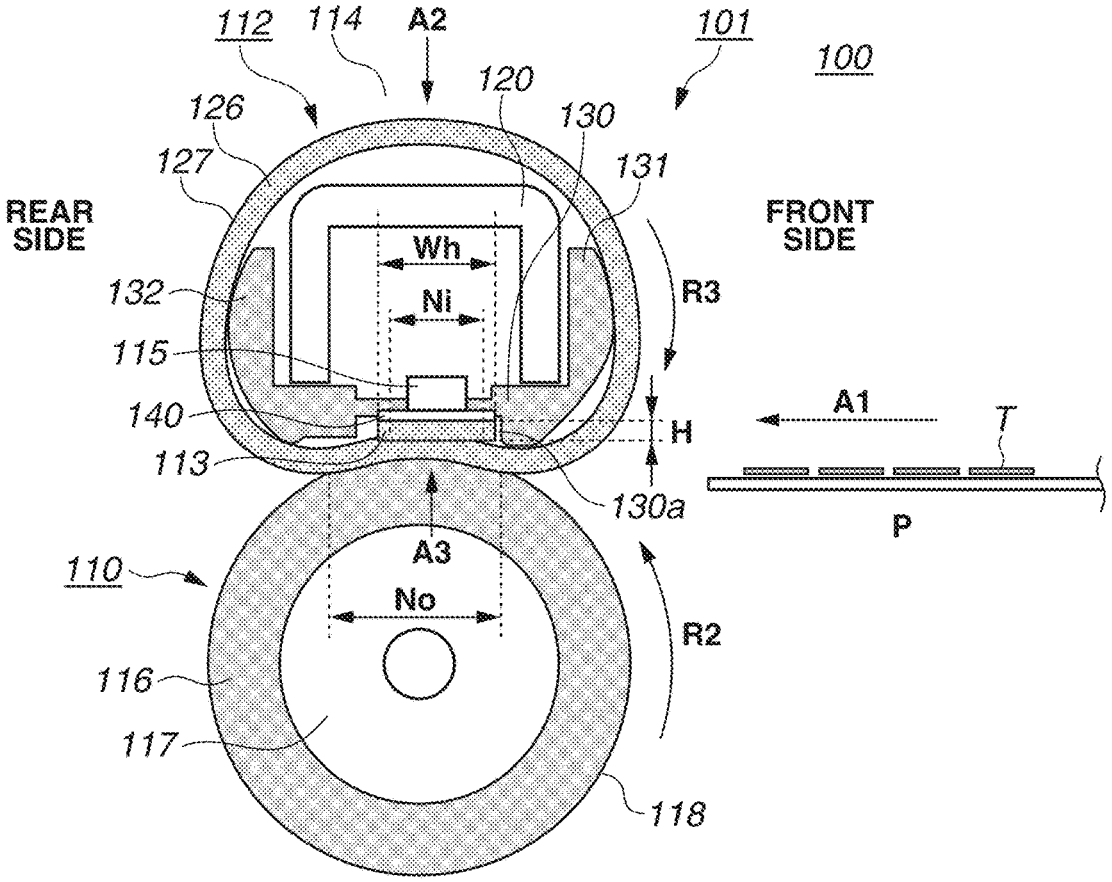
FIG. 13A is a schematic cross-sectional view of essential parts of a fixing apparatus according to a third exemplary embodiment.
Figure 13B:
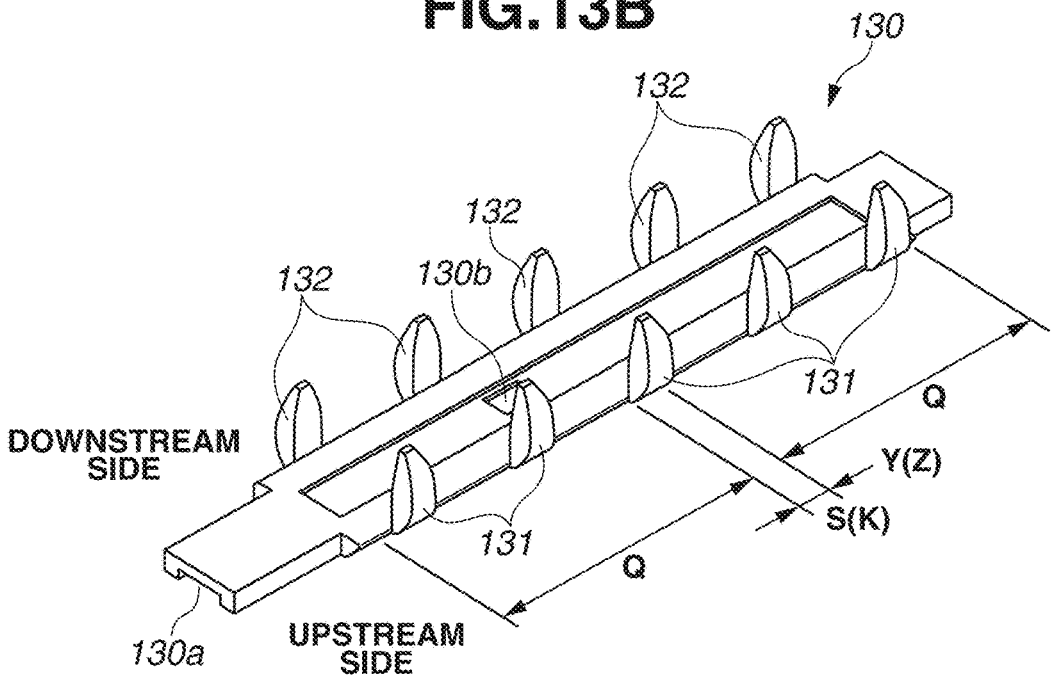
FIG. 13B is a schematic perspective view of a heater holder according to the third exemplary embodiment.
Figure 14A:
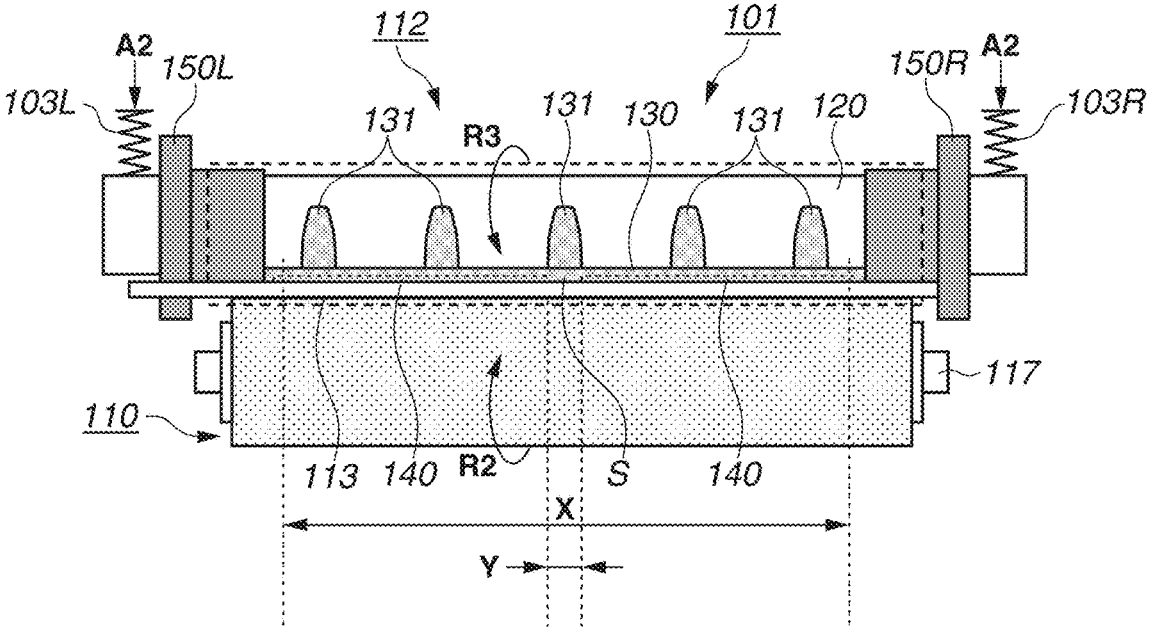
FIGS. 14A and 14B illustrate a configuration of the fixing apparatus according to the third exemplary embodiment.
Figure 14B:
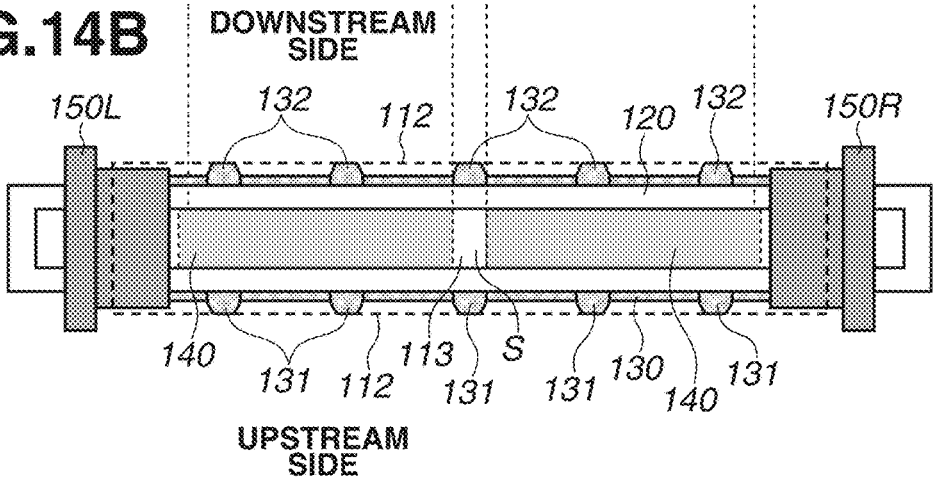

FIG. 13A illustrates a schematic cross-sectional view of the fixing apparatus 100 according to the present exemplary embodiment. FIG. 13B illustrates a schematic perspective view of a heater holder 130. FIG. 14A illustrates a schematic view of the fixing apparatus 100 as seen in the direction indicated by an arrow A1 illustrated in FIG. 13A. FIG. 14B illustrates a schematic view of the fixing apparatus 100 as seen in the direction indicated by an arrow A2 illustrated in FIG. 13A. In FIGS. 14A and 14B, the fixing film 112, the heater 113, and the heat conduction members 140 are illustrated by dotted lines in a transparent manner to facilitate understanding of the positional relationship between the support members for the fixing film 112 and the heat conduction members 140.

The heater holder 130 is provided with a plurality of upstream support members 131 spaced from each other in the longitudinal direction of the heater holder 130, and a plurality of downstream support members 132 spaced from each other in the longitudinal direction of the heater holder 130. The upstream support members 131 support the rotation of the fixing film 112 on the upstream side of the conveyance direction of the sheet P. The downstream support members 132 support the rotation of the film 112 on the downstream side thereof. The heater holder 130 used in the present exemplary embodiment is such that the support members 131 and 132 are integrally molded with a holding portion for holding the heater 113 and the heat conduction members 140.

In the present exemplary embodiment, the upstream support members 131 and the downstream support members 132 are arranged within the sheet passing region X, in the respective five positions in the longitudinal direction of the heater holder 130. The support members 131 and 132 are configured to support (guide) the rotation of the fixing film 112 by making contact with the inner surface of the fixing film 112. The portions where the support members 131 and 132 make contact with the fixing film 112 constitute respective third regions K.

Among the support members 131 and 132 in the five longitudinal positions, the support members 131 and 132 in the longitudinal central portion are configured to coincide with the position corresponding to the second region S of the heater 113 in the circumferential direction of the fixing film 112. In other words, the support members 131 and 132 in the longitudinal central portion are configured to also function as the contact members corresponding to the second region S. Variations in the temperature of the fixing film 112 in the width direction (longitudinal direction) are thereby prevented to suppress the occurrence of gloss unevenness.

Meanwhile, the support members 131 and 132 other than the ones in the longitudinal central portion support the fixing film 112 from the inner surface in the regions of the fixing film 112 corresponding to the first regions Q of the heater 113. If the fixing film 112 is supported by contact from the inner surface of the fixing film 112, the temperature of the fixing film 112 basically decreases in the locations where the support members 131 and 132 make contact with the fixing film 112.

However, if the fixing film 112 is supported from the inner surface in the regions of the fixing film 112 corresponding to the first regions Q of the heater 113, the temperature is uniformized by the heat conduction members 140. This alleviates the temperature decrease of the supported portions of the fixing film 112, and variations in the temperatures of fixing members such as the fixing film 112 and the pressure roller 110 in the longitudinal direction are less likely to occur.

In the foregoing second exemplary embodiment, the rotation of the fixing film 112 is supported from the inner surface by the inner surface guide portions 150*b* of the left and right flange members 150L and 150R at both ends of the fixing film 112. In the present exemplary embodiment, the rotation of the fixing film 112 is supported by the foregoing fixing members 131 and 132 also in the sheet passing region X. The support of the inner surface of the fixing film 112 in the sheet passing region X further stabilizes the rotation of the fixing film 112.

As described above, the fixing film 112 is powered to rotate by the pressure roller 110 in the fixing nip No. The fixing film 112 therefore rotates with reference to the position of the fixing nip No. The position of the fixing nip No is determined by the heater 113, which is positioned by the heater holder 130. Thus, the integration of the support members 131 and 132 for supporting the rotation of the fixing film 112, with the holding portion of the heater 113 has the advantage that the position of the rotation trajectory of the fixing film 112 can be easily determined.

As described above, in a configuration where the heat conduction members 140 are simply longitudinally divided, the second region S of the heater 113 becomes high in temperature if the heater 113 of the fixing apparatus 100 is started up in the cold state. This causes variations in the temperature of the fixing film 112.

In the configuration according to the present exemplary embodiment, the support members 131 and 132 of the fixing film 112 are arranged to coincide with the position corresponding to the second region S of the heater 113 in the circumferential direction of the fixing film 112. This can lower the high temperature of the fixing film 112 in the portion corresponding to the second region S, and reduce variations in the temperature of the fixing film 112 in the longitudinal direction.

Similarly to the second exemplary embodiment, in the configuration according to the present third exemplary embodiment, the support members 131 and 132 of the fixing film 112 increase in temperature when the fixing apparatus 100 enters the hot state. Therefore, even if the support members 131 and 132 are in contact with the inner surface of the fixing film 112, the support members 131 and 132 cannot easily take heat from the fixing film 112. Accordingly, variations in the temperature of the fixing film 112 are less likely to occur even in the hot state. As a result, in the configuration according to the present exemplary embodiment, variations in the temperatures of the fixing film 112 and the pressure roller 110 in the longitudinal direction are less likely to occur throughout the cold to hot states.

Similarly to the second exemplary embodiment, the configuration according to the present exemplary embodiment was checked for gloss unevenness. The occurrence of gloss unevenness due to temperature variations in the longitudinal direction was not observed even in solid images throughout the cold to hot states.

In the present exemplary embodiment, the configuration where the portions of the fixing film 112 corresponding to the first regions Q of the heater 113 are supported from the inner surface by the support members 131 and 132 has been described. However, if a temperature variation due to the support members 131 and 132 occur in the portions of the fixing film 112 corresponding to the first regions Q, the support members 131 and 132 may be configured not to make contact with the portions of the fixing film 112 corresponding to the first regions Q.

That is, the support members 131 and 132 may be configured to make contact with the fixing film 112 in the second region S, and not to make contact with the fixing film 112 in the first regions Q.

To reduce the startup time of the fixing apparatus 100, the heat capacity of the heat conduction members 140 may be reduced. For example, the heat conduction members 140 may be made of a thinner aluminum plate, a thin coating of silver paste having a high thermal conductivity, or a thin graphite sheet. In such a manner, if the heat conduction members 140 have a low heat capacity, the effect of uniformizing the heat of the heater 113 in the longitudinal direction by the heat conduction members 140 decreases.

Figure 15A:
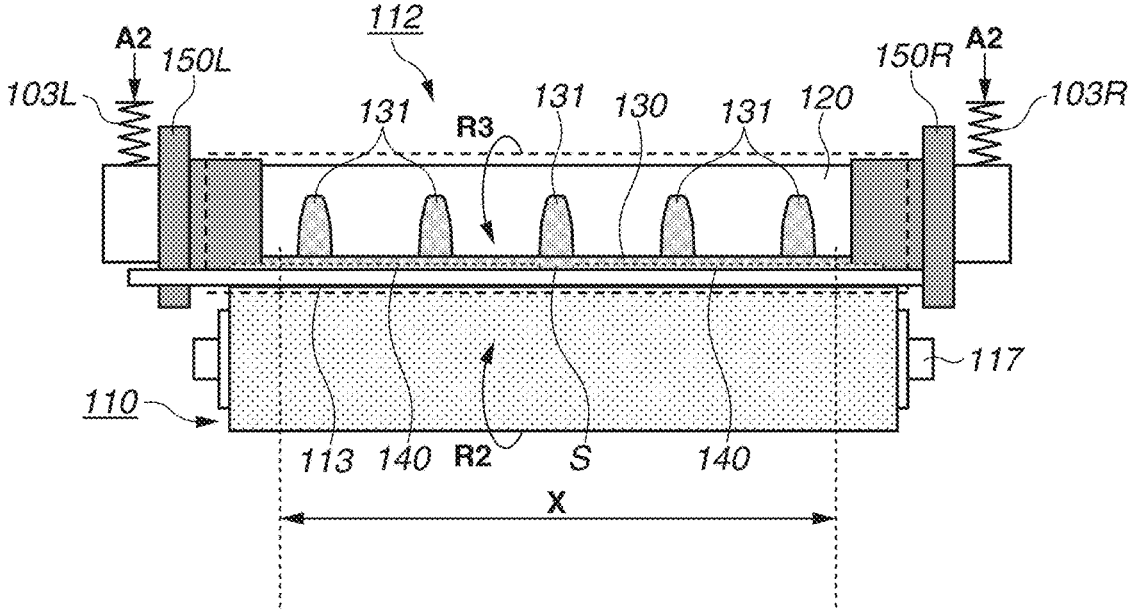
FIGS. 15A and 15B illustrate another configuration of the fixing apparatus according to the third exemplary embodiment.
Figure 15B:
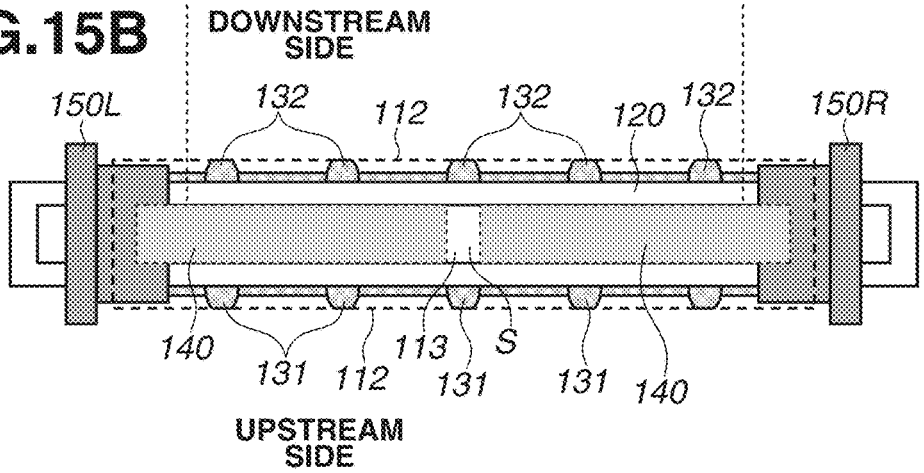

Thus, temperature variations can occur if the fixing film 112 is supported from the inner surface by the support members 131 and 132 in the portions of the fixing film 112 corresponding to the first regions Q. In this case, for example, as illustrated in FIGS. 15A and 15B, the support members 131 and 132 for the fixing film 112 may be configured so that only the support members 131 and 132 corresponding to the second region S of the heater 113 make contact with the inner surface of the fixing film 112. The support members 131 and 132 corresponding to the first regions Q may be configured not to make contact with the fixing film 112 during normal rotation.

For a purpose similar to the foregoing, the contact area, of the support members (contact members) 131 and 132, with the fixing film 112 in the third regions K may be configured to be wider than that of the support members 131 and 132 in the first regions Q.

The contact pressure, of the support members 131 and 132, with the fixing film 112 in the third regions K may be configured to be higher than that of the support members 131 and 132 in the first regions Q.

The thermal conductivity of the support members 131 and 132 in the third regions K may be configured to be higher than that of the support members 131 and 132 in the first regions Q.

Other exemplary embodiments will be described below.

Figure 16A:
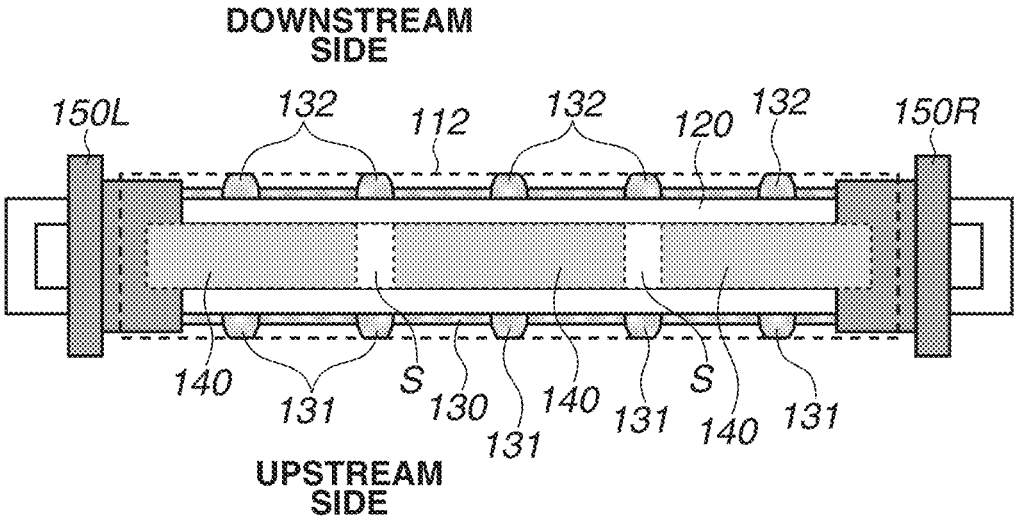
FIGS. 16A and 16B illustrate a configuration of a fixing apparatus in which a heat conduction member is divided into three.

1) In the second and third exemplary embodiments, the configuration where the heat conduction members 140 are provided by dividing a heat conduction member in two in the longitudinal central portion, so as to prevent deformation has been described. However, the configuration is not limited thereto. For example, as illustrated in FIG. 16A, a heat conduction member may be divided in three (heat conduction members 140). Even in such a configuration, the support members 131 and 132 for supporting the inner surface portions of the fixing film 112 corresponding to the second regions S of the heater 113 are arranged to coincide with the second regions S. As a result, variations in the temperature of the fixing film 112 in the longitudinal direction can be prevented to suppress gloss unevenness.

Figure 16B:
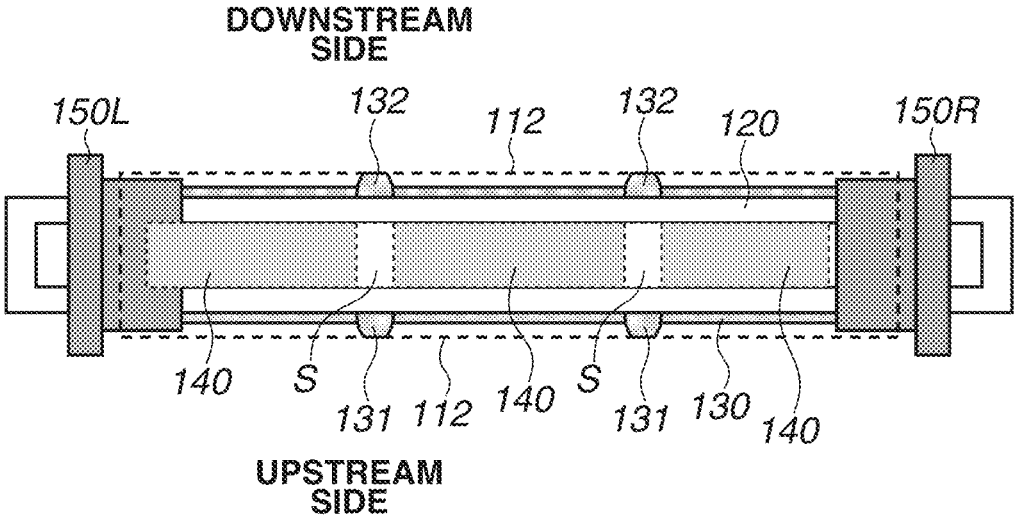

As describe above, if the heat capacity of the heat conduction members 140 is reduced to shorten the startup time of the fixing apparatus 100, gloss unevenness may occur. In such a case, the configuration illustrated in FIG. 16B may be used. More specifically, the support members 131 and 132 are configured to support the inner surface of the fixing film 112 only in the portions corresponding to the second regions S of the heater 113. This can suppress the occurrence of gloss unevenness.

Figure 17:
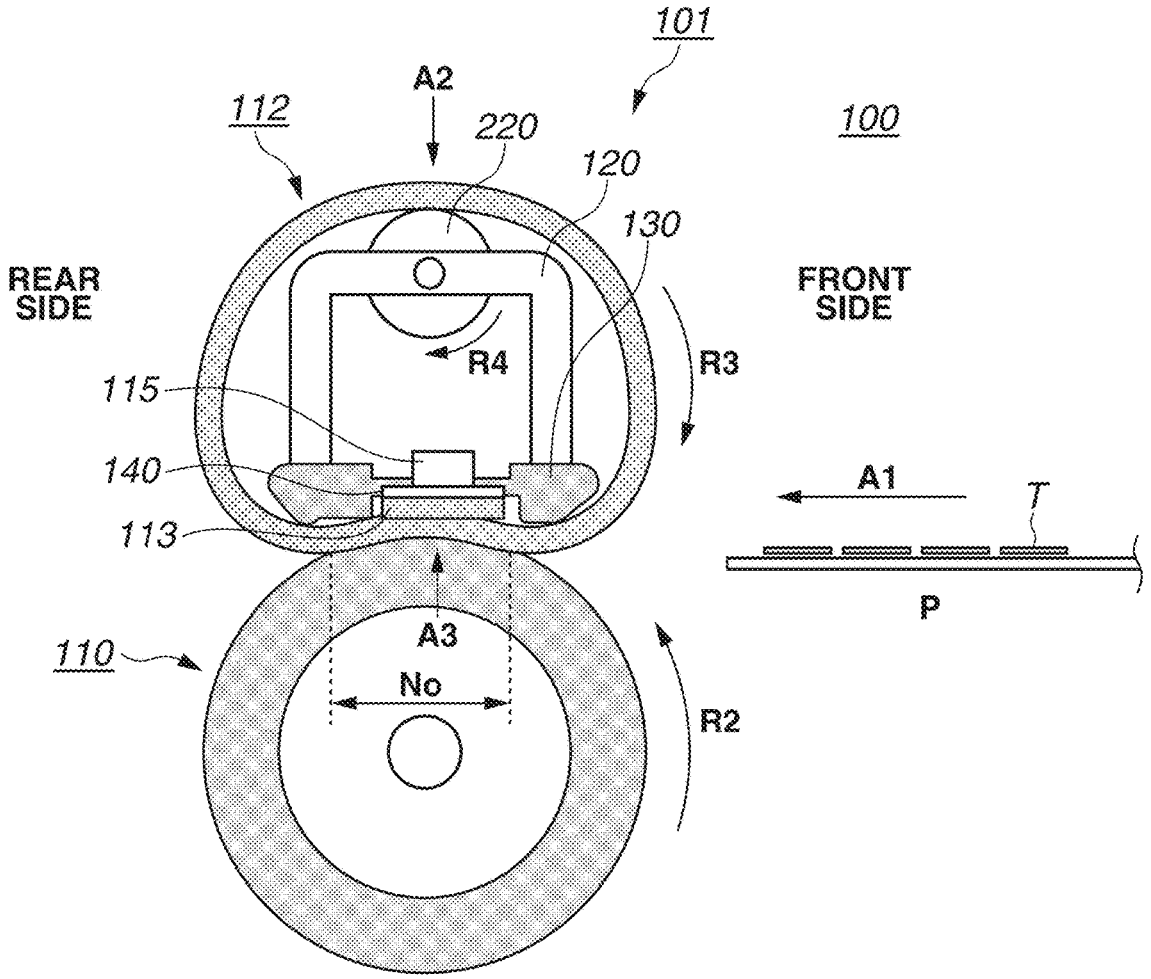
FIG. 17 illustrates another configuration of the fixing apparatus.

2) In the second and third exemplary embodiments, the contact member 190 and the support members 131 and 132 for making contact with and sliding over the inner surface of the fixing film 112 in the portion of the fixing film 112 corresponding to the second region S of the heater 113 have been described. However, the configuration is not limited thereto. For example, as illustrated in FIG. 17, a rotating contact member 220 may be provided.

The rotating contact member 220 is arranged in an upper position of the stay 120 to correspond to the second region S of the heater 113 in the circumferential direction of the fixing film 112. The rotating contact member 220 is configured to make contact with the inner surface of the rotating fixing film 112 and rotate in the direction indicated by an arrow R4 illustrated in FIG. 17. Configuring the contact member 220 for making contact with the fixing film 112 as a rotating member not only can reduce the rotation torque of the fixing film 112, but also can suppress the occurrence of wear and scratches on the inner surface of the fixing film 112.

3) In the second and third exemplary embodiments, the contact member 190 and the support members 131 and 132 for making contact with the inner surface of the fixing film 112 at portions where the heat conduction members 140 are not in contact with the back side of the heater 113 have been described. However, the configuration is not limited thereto. A contact member for making contact with an outer surface of the fixing film 112 may be provided.

Figure 18:
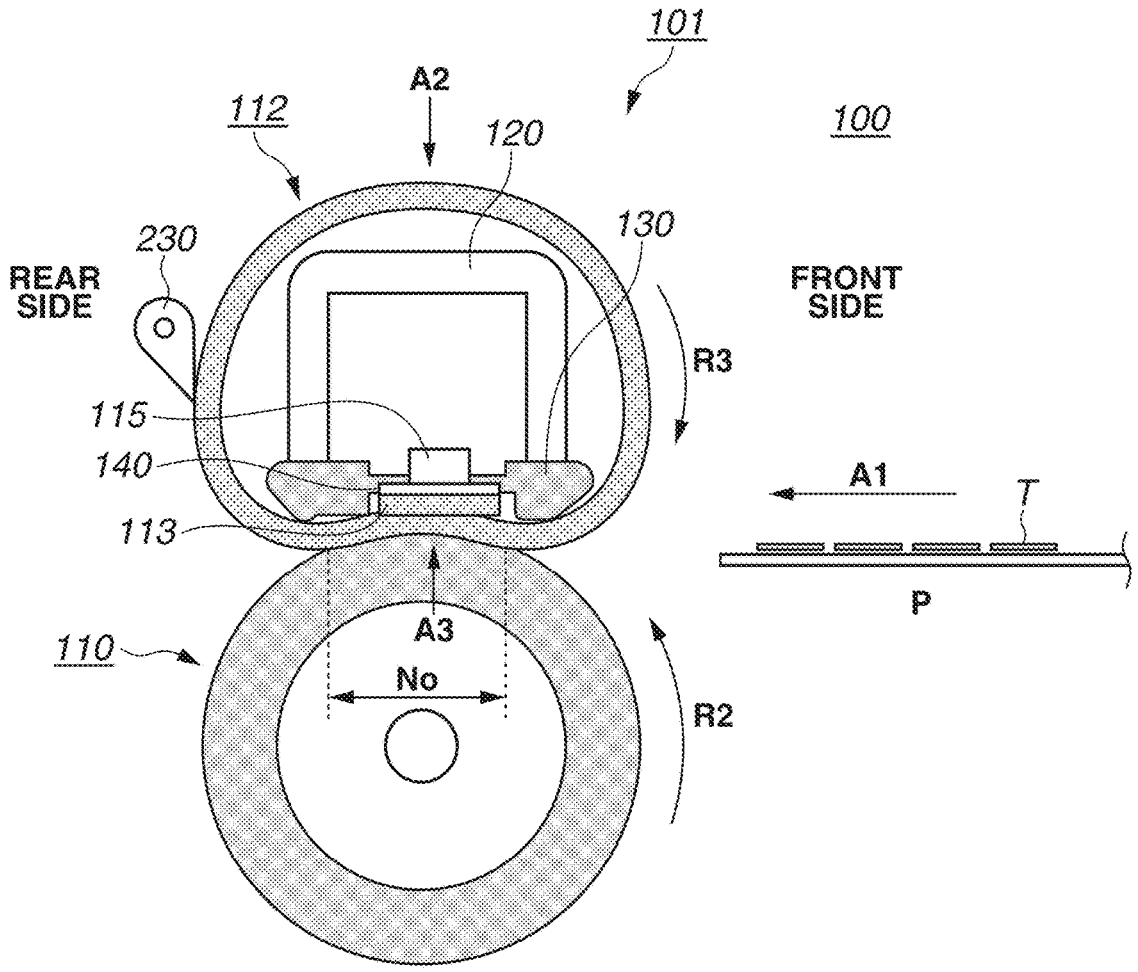
FIG. 18 illustrates yet another configuration of the fixing apparatus.

FIG. 18 illustrates an example where a separation claw 230 for separating the sheet P from the fixing film 112 if the sheet P is about to get wound around the fixing film 112 is put in contact with the outer surface of the fixing film 112. The separation claw 230 is arranged to coincide with a position corresponding to the second region S of the heater 113 in the circumferential direction of the fixing film 112. That is, the separation claw 230 also functions as a contact member. As a result, variations in the temperature of the fixing film 112 in the width direction (longitudinal direction) are prevented to suppress the occurrence of gloss unevenness.

The contact member for making contact with the outer surface of the fixing film 112 is not limited to the separation claw 113. Any contact member arranged to coincide with a position corresponding to the second region S of the heater 113 in the circumferential direction of the fixing film 112 can provide an operation and effect similar to the foregoing.

4) In the second and third exemplary embodiments, the fixing apparatuses with the same configuration for a monochrome image forming apparatus have been described. However, the configuration is not limited thereto. For example, a configuration using a film including a rubber layer as the fixing film 112, which is often used in a color image forming apparatus, may be used. Further, a fixing apparatus that uses a solid rubber as the rubber layer of the pressure roller 110 may be used.

In such a color image forming apparatus, the fixing film 112 and the pressure roller 110 have a high heat capacity, and thereby temperature variations in the longitudinal direction are likely to be alleviated. However, the superposition of a plurality of color toner images increases the use amount of toner as compared to a monochrome image, and gloss unevenness due to temperature variations can occur more easily.

5) If glossy paper is used as the sheet P, high glossiness (gloss) is required and gloss unevenness may be easily visible. In such a color image forming apparatus, the heat conduction members 140, obtained by dividing a heat conduction member, can be used on the back side of the heater in the foregoing manner. More specifically, a contact member is arranged to coincide with a position corresponding to the second region S of the heater 113 in the circumferential direction of the fixing film 112 and put into contact with the fixing film 112, so that gloss unevenness due to temperature variations can be suppressed.

6) In the foregoing configurations, the fixing apparatus that fixes the toner image T to the sheet P in the fixing nip No formed between the fixing film 112 and the pressure roller 110 has been described. The exemplary embodiments of the present invention can be applied to a fixing apparatus of external heating type such as that illustrated in FIG. 19 to suppress gloss unevenness.

In a fixing apparatus 100 of such an external heating type, the heater 113 included inside the fixing film 112 is pressed against an outer surface of a fixing roller 3000 to heat the surface of the fixing roller 3000 in a heating nip N2. The fixing apparatus 100 is configured to fix the toner image T to the sheet P in a fixing nip N1 which is formed by bringing a pressure roller 301, serving as a nip portion forming member, into a press contact with the fixing roller 3000.

Even in such a configuration, the heat conduction members 140, obtained by dividing a heat conduction member, can be arranged on the back side of the heater 113 by using a configuration similar to those of the second and third exemplary embodiments. More specifically, the contact member 190 or the like for making contact with the fixing film 112 is arranged to coincide with a position corresponding to the second region S of the heater 113 in the circumferential direction of the fixing film 112. As a result, temperature variations in the longitudinal direction can be alleviated to provide an operation and effect similar to the foregoing.

7) In the above-described configurations, the heater 113 heats the fixing film 112 in the nip portion formed by opposing the heater 113 to the pressure roller 110 or the fixing roller 3000. However, the configuration is not limited thereto.

Figure 20:
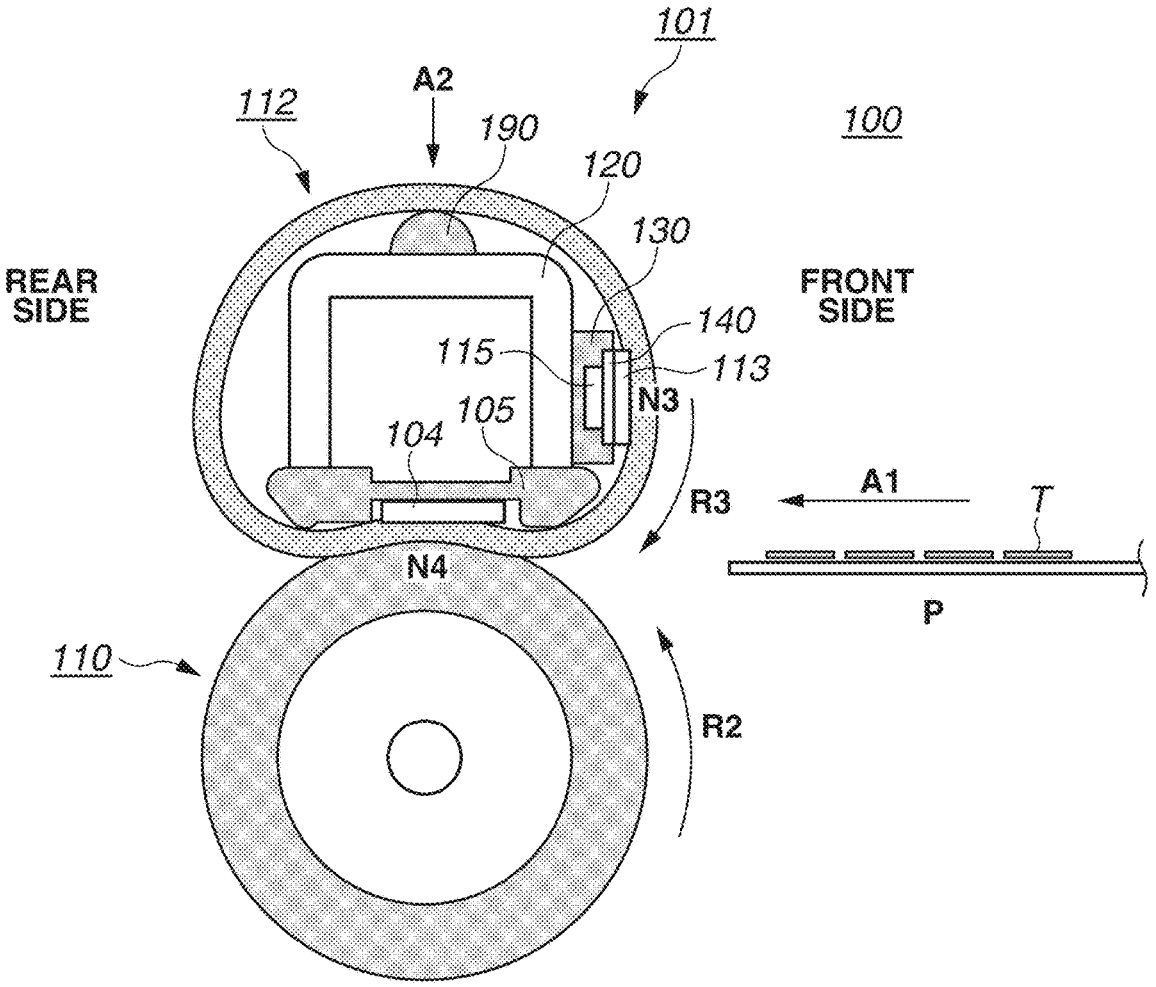
FIG. 20 illustrates yet another configuration of the fixing apparatus.

As illustrated in FIG. 20, a heating nip N3 formed between the heater 113 and the inner surface of the fixing film 112 may be arranged in a location other than a fixing nip N4 formed between the outer surface of the fixing film 112 and the pressure roller 110. A sliding plate 104 and a holding member 105 thereof serving as backup members are arranged inside the fixing film 112 and opposed to the pressure roller 110 with the fixing film 112 therebetween.

Even in such a configuration, the heat conduction members 140, obtained by dividing a heat conduction member, can be arranged on the back side of the heater 113 by using a configuration similar to those of the second and third exemplary embodiments. More specifically, the contact member 190 or the like for making contact with the fixing film 112 is arranged to coincide with a position corresponding to the second region S of the heater 113 in the circumferential direction of the fixing film 112. As a result, temperature variations in the longitudinal direction can be alleviated to provide an operation and effect similar to the foregoing.

8) Aside from the fixing apparatus for fixing the unfixed toner image T as a fixed image, the image heating apparatus includes an image quality modification apparatus for applying heat and pressure again to a toner image temporarily fixed or once thermally fixed to a recording material to improve glossiness.

Figure 19:
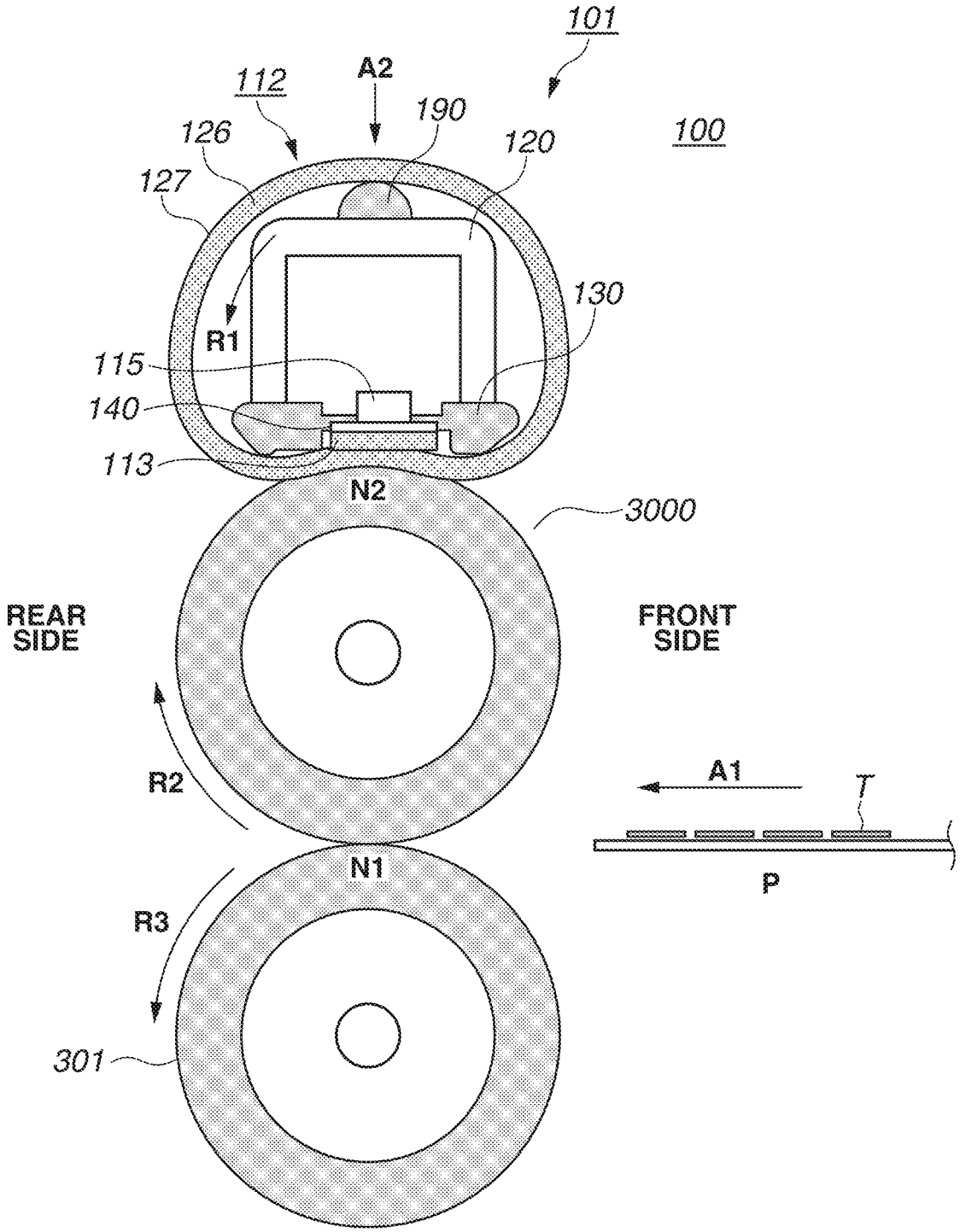
FIG. 19 illustrates yet another configuration of the fixing apparatus.

9) In the fixing apparatus illustrated in FIG. 19, the pressure roller 301 serving as a nip portion forming member may be replaced with a non-rotating member. Examples of the non-rotating member include a horizontally long pad-like member having a coefficient of surface friction lower than those of the fixing roller 3000 and the sheet P. The sheet P guided into the fixing nip N1 is sandwiched and conveyed through the fixing nip N1 by a rotational conveyance force of the fixing roller 3000 while its back side (non-image formation surface side) slides over the surface of the nip portion forming member configured as the non-rotating member where the coefficient of friction is low.

10) The image forming unit for forming a toner image on the sheet P in the image forming apparatus is not limited to the electrophotographic image forming unit of transfer type according to the exemplary embodiments. For example, the image forming unit may be an electrophotographic image forming unit that uses photosensitive paper as the sheet P and forms a toner image thereon by a direct method. The image forming unit may also be an electrostatic recording image forming unit or a magnetic recording image forming unit of transfer type which uses an electrostatic recording dielectric material or a magnetic recording magnetic material as an image bearing member. Furthermore, the image forming unit may be an electrostatic recording image forming unit or a magnetic recording image forming unit that uses electrostatic recording paper or magnetic recording paper as the recording material and forms a toner image thereon by a direct method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

a heating member configured to include a long narrow substrate and a heat generation resistor, which generates heat by being energized, longitudinally formed on the substrate;

an endless belt configured to be able to rotate around the heating member with its inner peripheral surface being in contact with and sliding over a first surface of the heating member;

a heat conduction member configured to be in contact with a second surface of the heating member and having a thermal conductivity higher than a thermal conductivity of the substrate;

a guide member configured to support the rotation of the endless belt by being in contact with the endless belt; and a nip portion forming member configured to form, with the endless belt, a nip portion by being in contact with an outer peripheral surface of the endless belt, wherein the image heating apparatus heats a recording material on which an image is born while the recording material is sandwiched and conveyed, and wherein, in a direction orthogonal to a conveyance direction of the recording material within a conveyance path of the recording material, a first region included within a passing region of the recording material of maximum width size conveyable by the image heating apparatus and in which the heat conduction member is in contact with the heating member is wider than a second region included within the passing region and in which the heat conduction member is not in contact with the heating member, and a contact member of the guide member, which protrudes in the conveyance direction and contacts the endless belt, is arranged in a position corresponding to the second region.

2. An image heating apparatus according to claim 1, wherein the recording material is conveyed in the nip portion while being sandwiched between the nip portion forming member and the endless belt at the nip portion.

3. An image heating apparatus according to claim 1, wherein the nip portion forming member is a rotating member.

4. An image heating apparatus according to claim 1, wherein the contact member is in contact with an inner surface of the endless belt.

5. An image heating apparatus according to claim 1, wherein in a longitudinal direction of the substrate, width of the contact member is substantially identical to width of the second region.

6. An image heating apparatus according to claim 1, wherein contact pressure, of the guide member, with the endless belt is higher in the second region than in the first region.

7. An image heating apparatus according to claim 1, wherein thermal conductivity of the guide member in the second region is higher than thermal conductivity of the guide member in the first region.

8. An image heating apparatus according to claim 1, wherein the guide member is not in contact with the endless belt in the first region.

9. An image heating apparatus according to claim 1, wherein the contact member protrudes from a support portion which supports the heating member.

10. An image heating apparatus according to claim 1, wherein the contact member protrudes in a direction orthogonal to the conveyance direction and to a longitudinal direction of the substrate.

* * * * *